US011981359B2

(12) United States Patent
Anderson et al.

(10) Patent No.: US 11,981,359 B2
(45) Date of Patent: May 14, 2024

(54) SYSTEM FOR A BRIDGE PLATE ASSEMBLY

(71) Applicant: Transportation IP Holdings LLC, Norwalk, CT (US)

(72) Inventors: John D. Anderson, Oswego, IL (US); Walter J. Peach, Montgomery, IL (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 288 days.

(21) Appl. No.: 17/339,838

(22) Filed: Jun. 4, 2021

(65) Prior Publication Data

US 2021/0380146 A1 Dec. 9, 2021

Related U.S. Application Data

(60) Provisional application No. 63/035,146, filed on Jun. 5, 2020.

(51) Int. Cl.
*B61D 3/18* (2006.01)

(52) U.S. Cl.
CPC ..... *B61D 3/187* (2013.01)

(58) Field of Classification Search
CPC ..... B61D 3/187; B61D 3/18
See application file for complete search history.

(56) References Cited

U.S. PATENT DOCUMENTS 5,596,936 A * 1/1997 Bullock ..... B61D 3/187 105/458
10,442,446 B2 10/2019 Anderson et al.
2017/0334463 A1* 11/2017 Anderson ..... B61D 3/187

* cited by examiner

*Primary Examiner* — Scott A Browne
(74) *Attorney, Agent, or Firm* — McCoy Russell LLP

(57) ABSTRACT

Methods and systems are provided for locking assemblies of a pair of bridge plates placed between adjacent railcars. In one example, a bridge plate assembly may include a locking assembly with a guide tube shifted to a side from a center of a bridge plate and a pivot pin coupled to the guide tube protruding out of a left side or a right side of the bridge plate.

15 Claims, 15 Drawing Sheets

500
310
304
502
B'
B
C'
C
306
312

520
310
L2
322
304
502
306
L1
324
312

540
312
306
304
550
C'
C
B'
B
310

560
312
L3
324
550
306
304
L4
322
310

SYSTEM FOR A BRIDGE PLATE ASSEMBLY

CROSS REFERENCE TO RELATED APPLICATION

The present application claims priority to U.S. Provisional Patent Application No. 63/035,146, entitled "SYSTEM FOR A BRIDGE PLATE ASSEMBLY", and filed on Jun. 5, 2020. The entire contents of the above-listed application are hereby incorporated by reference for all purposes.

TECHNICAL FIELD

Embodiments of the subject matter disclosed herein relate to a locking assembly of a bridge plate used in a railcar.

DISCUSSION OF ART

Auto-rack railroad cars are widely used for transporting vehicles such as automobiles, vans, and trucks often over thousands of miles. Auto-rack railroad cars (which are one example of a railcar) may have one or more decks for accommodating the vehicles. Prior to loading or unloading a string or series of connected or coupled rail-cars, pairs of bridge plates may be positioned in gaps between two adjacent railcars such that each gap between each pair of adjacent decks of adjacent auto-rack cars is spanned by a pair of portable, identical, and removable bridge plates. The vehicles are loaded in the railcars by driving the vehicles onto one end of the string or series of connected or coupled railcars, over the bridge plates and through the adjacent cars until all of the auto-rack cars in the series or string are filled.

Association of American Railroads (AAR) specifications set forth a maximum weight, a minimum strength requirement, and a fatigue load for such bridge plates. A standard bridge plate may have a specific width and length in accordance with the dimension of a gap between adjacent railcars. Each pair of identical bridge plates supports a vehicle as it is driven over the gap between the aligned decks of the adjacent railcars with one bridge plate supporting the right side and the other bridge plate supporting the left side of the vehicle.

Certain vehicles may have a wider wheel base which may not be accommodated within the distance between two standard bridge plates placed between adjacent railcars. Due to the wider wheel base, such vehicles may not be moved between adjacent rail cars and may have to be unloaded from the railcar carrying them without the possibility of being transported through junctions between railcars. Instead of using a common ramp (such as a buck ramp) at one end of the string or series of connected or coupled railcars to load/unload all vehicles, a separate ramp may need to be coupled to the specific railcar carrying the wider wheel base vehicles to unload/load these vehicles. The inability to be driven through multiple rails-cars with the capability of being loaded/unloaded from one ramp at an end of the string or series of connected or coupled railcars may add to the time needed for loading and unloading all vehicles to the railcars. Further additional manpower and machine power may be needed to complete the task. Therefore, it may be desirable to have a system and method that differs from those that are currently available.

BRIEF DESCRIPTION

In an embodiment, a system for a bridge plate assembly includes a bridge plate and a locking assembly with a guide tube holding a pivot pin. The locking assembly has a center shifted to a side from a center of the bridge plate. In this way, by having a locking assembly offset from a center of a bridge plate, a distance between two outer edges of parallelly placed bridge plates may be increased.

DETAILED DESCRIPTION

Figure 12:
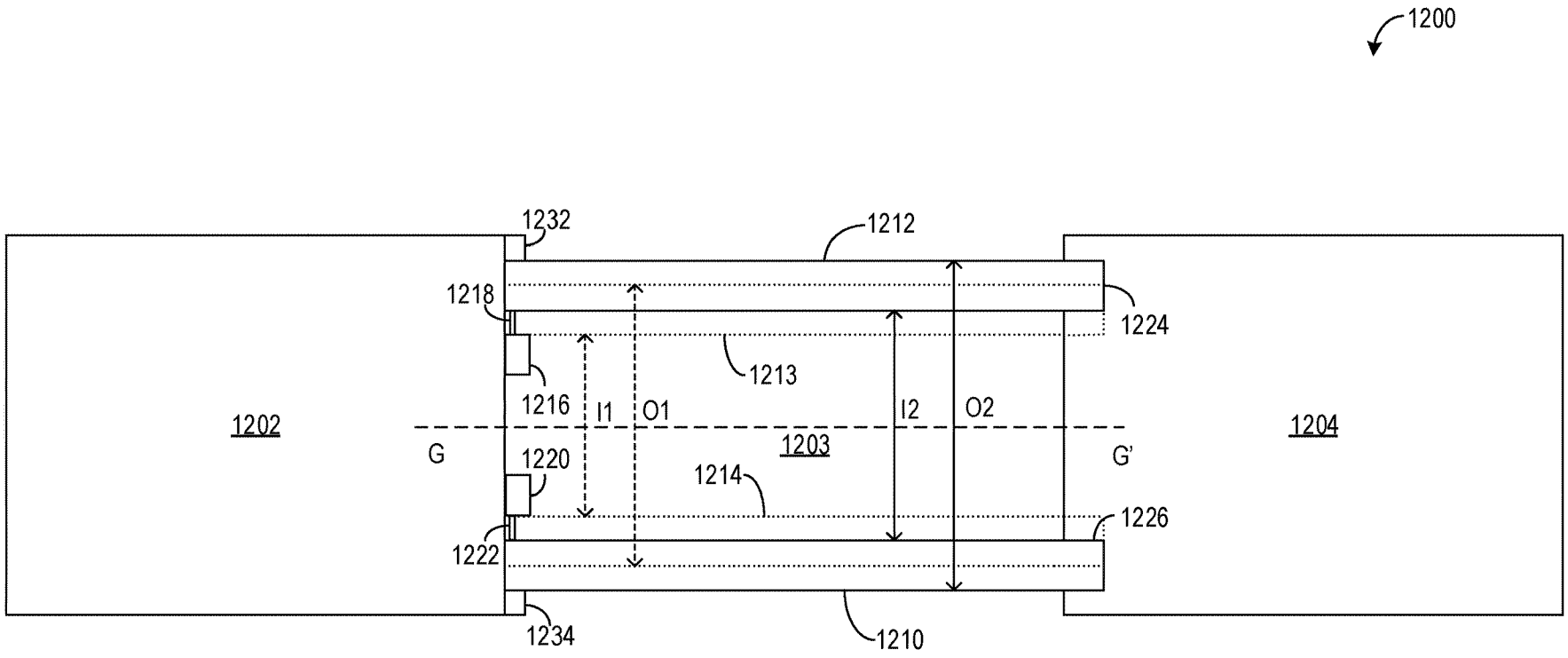
FIG. 12 shows an example coupling of a pair of railcar bridge plates in a gap between two adjacent railcars.
Figure 13:
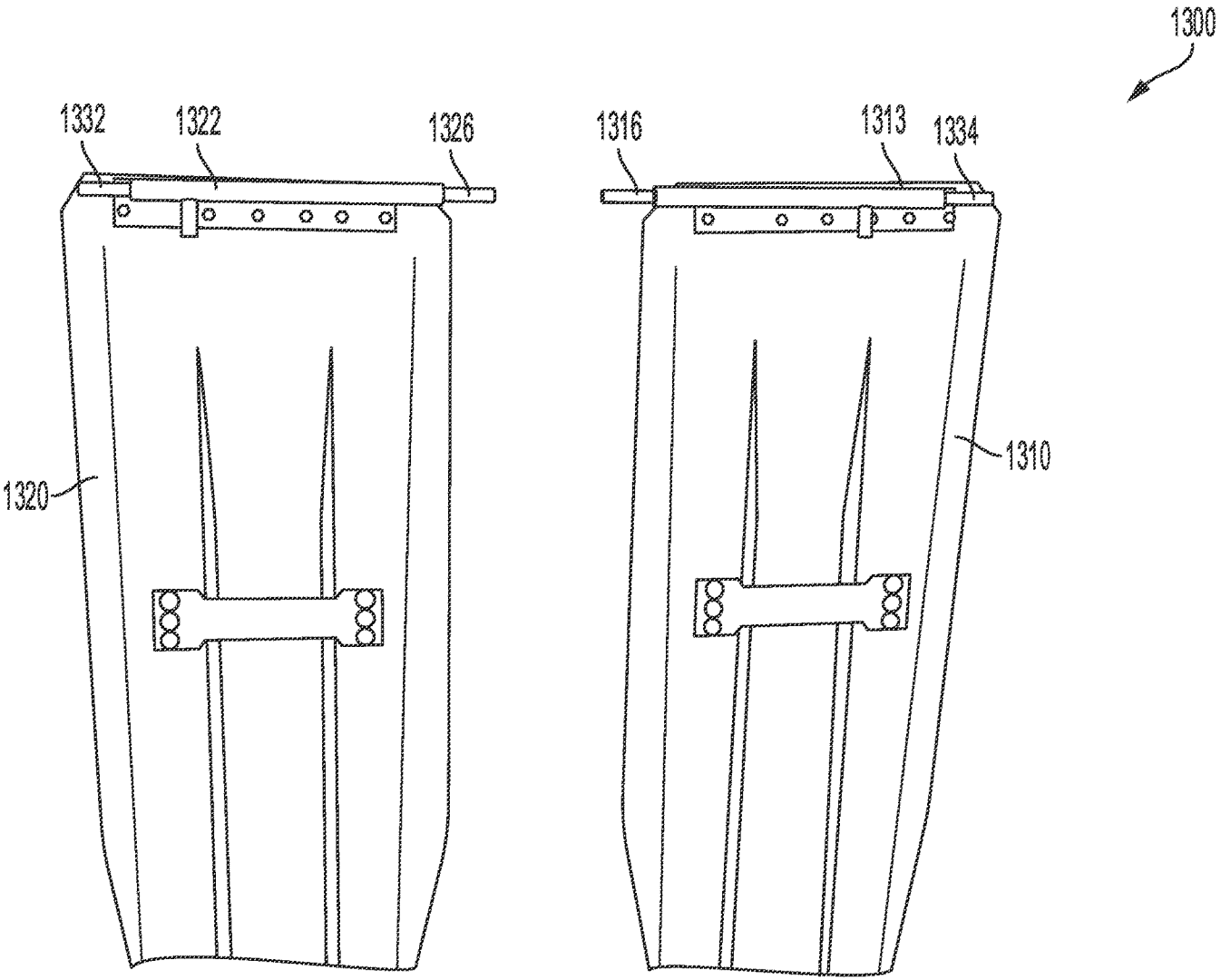
FIG. 13 shows an example pair of railcar bridge plates.
Figure 14B:
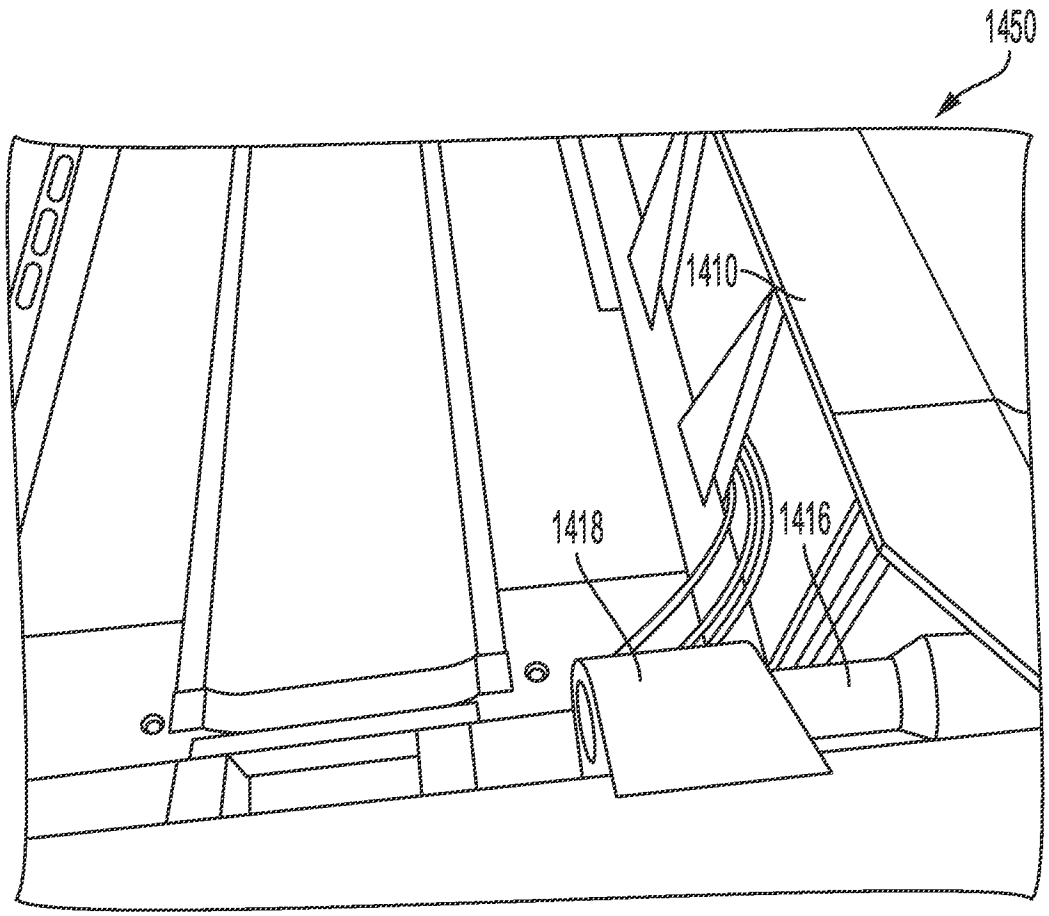
FIG. 14B shows attachment of a left-aligned bridge plate to a deck of a railcar.
Figure 14A:
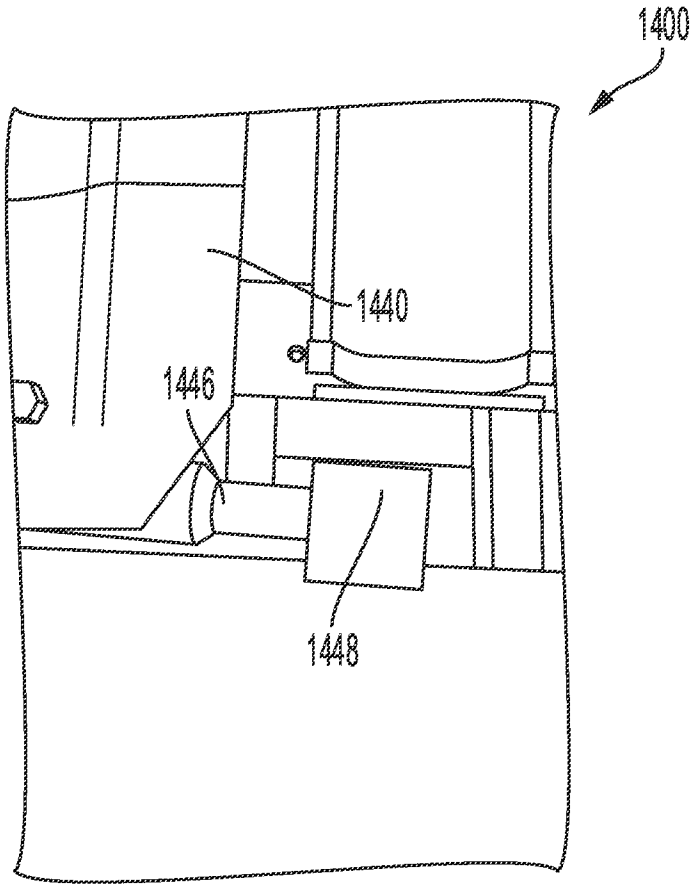
FIG. 14A shows attachment of a right-aligned bridge plate to a deck of a railcar.
Figure 15:
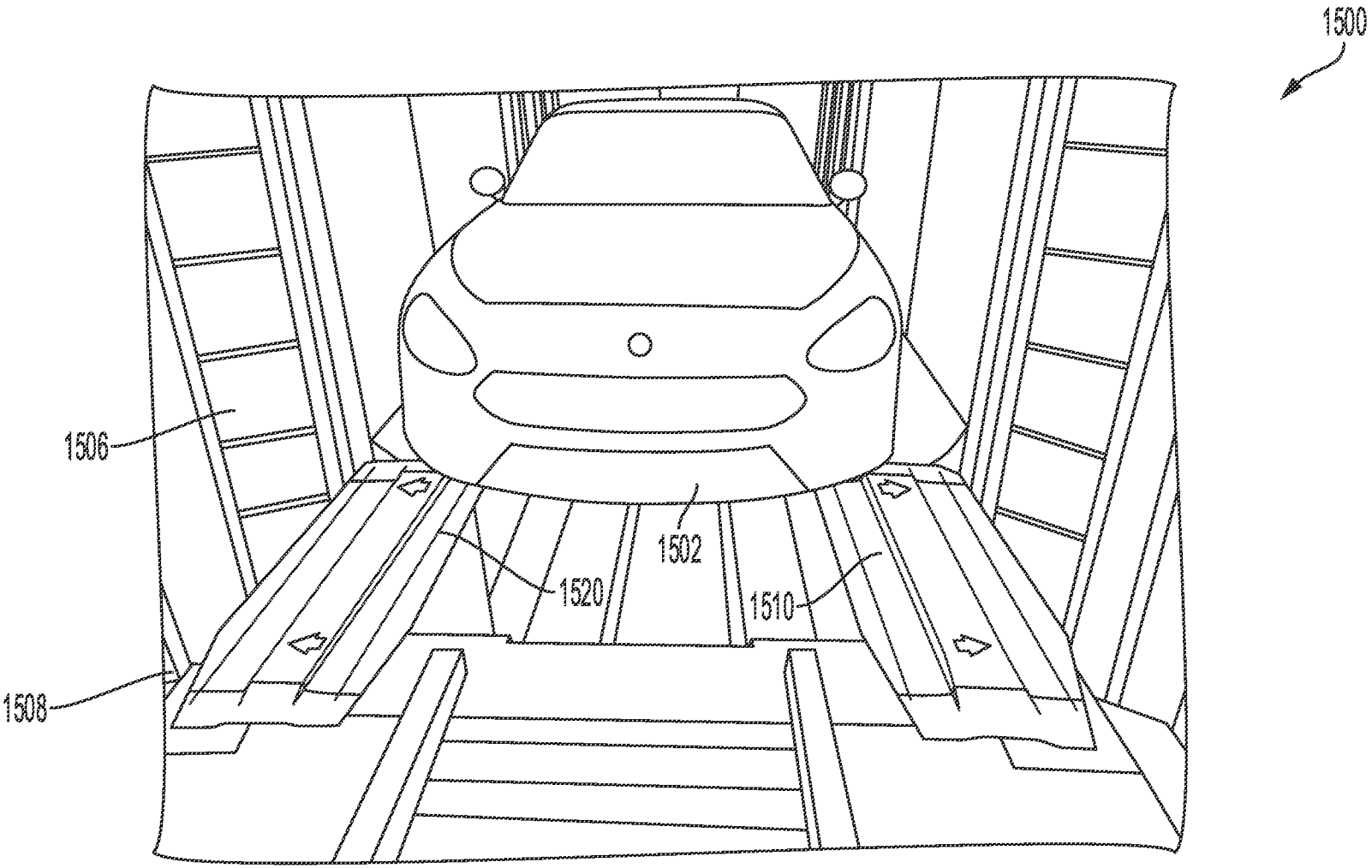
FIG. 15 shows a vehicle being transferred between two railcars using bridge plates.

The following description relates to systems for a locking assembly of a bridge plate used to bridge a gap between two adjacent railcars. A series of connected railcars, such as a railcar shown in FIG. 1, may be used to transport automobiles and other vehicles from a manufacturing facility to a delivery location. During loading/unloading of vehicles onto the series of connected railcars, as shown in FIG. 12, a pair of bridge plates may be used to bridge a gap between two adjacent railcars and a vehicle may be driven over the plates. Three example embodiments of bridge plates with three distinct locking assemblies are shown in FIGS. 2-11. A pair of railcar bridge plates is shown in FIG. 13. The bridge plates may be coupled to the junction of two adjacent railcars via receiving ports, as shown in FIGS. 14A-B. Once two bridge plates are attached between two adjacent railcars, a vehicle may be driven between these adjacent railcars via the bridge plates, as shown in FIG. 15. The separation between the two parallelly placed bridge plates is desired to be sufficient to support the wheel base of a vehicle driven over the bridge plates.

As one example, each bridge plate may include a locking assembly (also referred as a latch or hinge) including a fixed pivot pin and a slidable locking pin mounted on each end of a guide tube attached to the bridge plate. The slidable locking pin may extend along the length of the guide tube and engage with a receiving port of a railcar. A handle may be provided in the guide tube to slide the locking pin to engage and disengage the bridge plate from a junction between two railcars. The positioning of the guide tube along with the locking pin and the pivot pin may be adjusted based on a desired characteristic of the bridge plate. In a first embodiment of the bridge plate, also referred herein as a left-aligned bridge plate, a left-aligned locking assembly may be mounted at one end of the bridge plate. In a left-aligned locking assembly, the guide tube may be mounted on the bridge plate such that the pivot pin protrudes out of the left edge of the bridge plate. In a second embodiment of the bridge plate, also referred herein as a right-aligned bridge plate, a right-aligned locking assembly may be mounted at one end of the bridge plate. In a right-aligned locking assembly, the guide tube may be mounted on the bridge plate such that the pivot pin protrudes out of the right edge of the bridge plate. In a third embodiment of the bridge plate, also referred herein as a center-aligned bridge plate, a center-aligned locking assembly may be mounted at one end of the bridge plate. In a center-aligned locking assembly the guide tube may be mounted on the bridge plate such that the pivot pin is centrally positioned and does not protrude out of any edge of the bridge plate. The left-aligned bridge plate may be lined along the right side of the gap between two railcars (junction) and when the locking pins are attached to the receiving ports at each end of the gap, the protruded portions of the pivot pins cause the bridge plate to the shifted further outward to the right. Similarly, the right-sided bridge plate may be lined along the left side of the gap between two railcars and when the locking pins are attached to the receiving ports, the protruded portions of the pivot pins cause the bridge plate to be shifted further outward to the left. Due to shifting of each bridge plate away from the center of the gap, the effective distance between the outer edges of the bridge plates may increase. At the increased distance between the outer edges, it may be possible to accommodate and transfer wider wheel base vehicles via the bridge plates.

In this way, by shifting a components of the locking assembly attached to an end of a bridge plate, it possible to shift the bridge plates outward and away from the center of a gap in a junction of two railcars, thereby increasing the distance between the outer edges of the bridge plates. By increasing the distance between the outer edges, it is possible to accommodate vehicles with wider wheel bases. Further, the distance between the inner edges of two parallelly placed bridge plates may remain sufficient to support vehicles with narrower wheel bases. The technical effect of using the modified locking assembly is that by having a dedicated left-aligned bridge plate and a right-aligned bridge plate, assembly of the bridge plates on the railcar junctions may be simplified. Thereby, it is possible to load vehicles at one end of the string or series of connected or coupled railcars and transfer the vehicles from one railcar to another for efficient loading/unloading.

Figure 1:
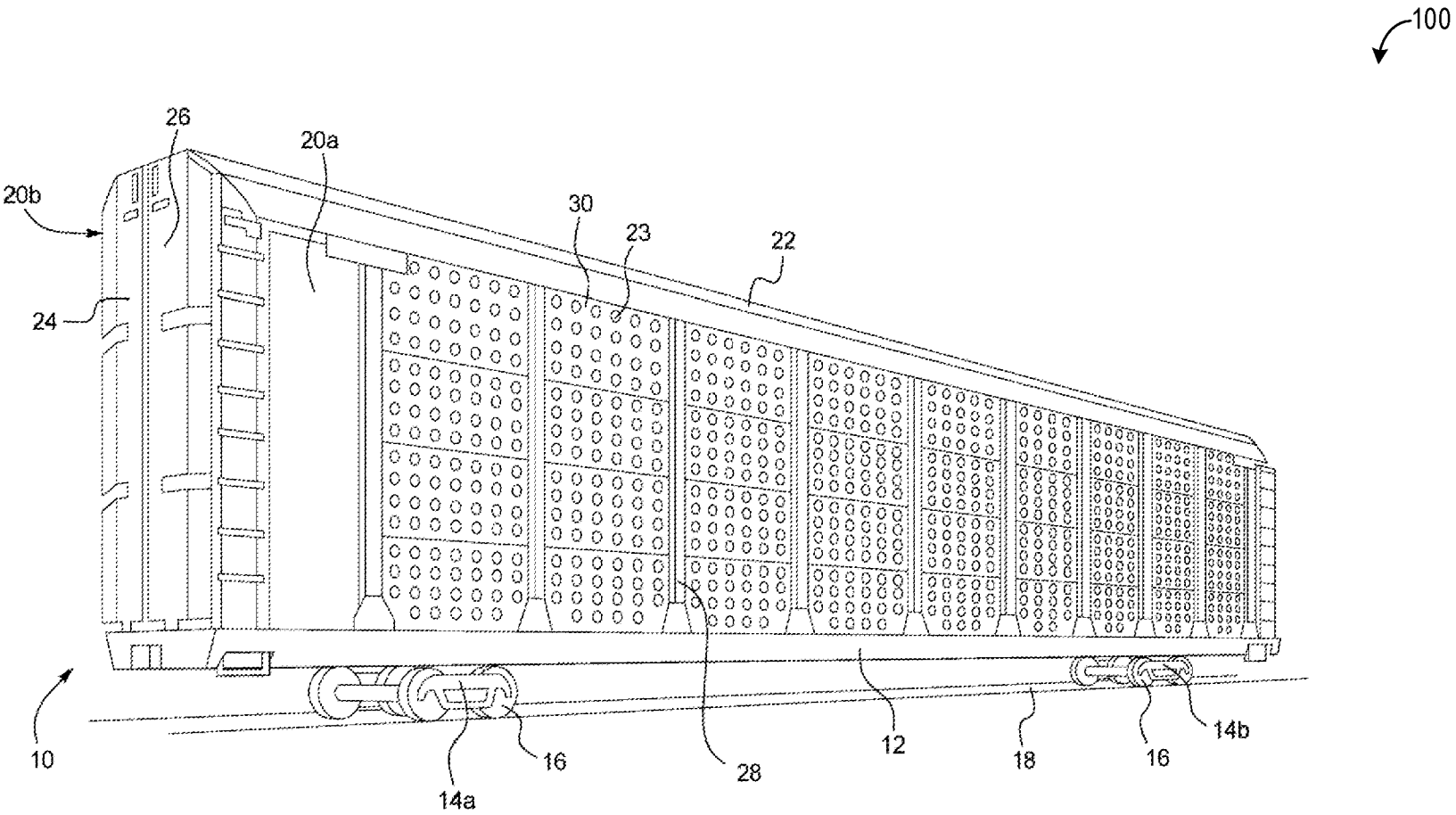
FIG. 1 shows a side perspective view of an auto-rack railroad car configured to transport a plurality of vehicles.

FIG. 1 shows an example embodiment 100 of railcar (also referred herein as auto-rack car) 10 including a frame 12 supported by trucks 14*a* and 14*b*, each of which has a plurality of wheels 16 configured to roll along conventional railroad tracks 18. The frame 12 supports two opposing sidewalls 20*a* and 20*b* and a roof 22. Vehicles may be carried on parallel (stacked) decks placed within a railcar. In one example, the railcar 10 includes a pair of co-acting clamshell doors 24 and 26 mounted on each end of the railcar 10. In another example, the railcar 10 may include composite constructed doors which may be opened/closed via a tri-fold operation. The doors 24 and 26 are opened to facilitate the loading and unloading of vehicles into and out of the railcar 10 and are closed during transport or storage of the vehicles. Bridge plate assemblies of the present disclosure may be employed on such railcars or otherwise configured railcars.

The sidewalls 20*a* and 20*b* include a series of steel vertical posts 28 that are mounted on and extend upwardly from the frame 12. The roof 22 is mounted on and supported by these vertical posts 28. The vertical posts 28 are evenly spaced along the entire length of both sidewalls 20 of the auto-rack car 10. A plurality of rectangular galvanized steel side wall panels 30 that extend horizontally and are vertically spaced apart are mounted between each pair of vertical posts 28. These side wall panels 30 are supported at their corners by brackets (not shown) that are secured to the vertical posts. A side wall panel 30 may include a multiplicity of round sidewall panel holes 23. These side wall panel holes 23 provide the railcar with natural light as well as proper ventilation.

A string or series of railcars may be connected or coupled and during loading/unloading, vehicles are driven from one railcar to another. In order to drive through a junction between two adjacent railcars, a pair of detachable bridge plates may be placed in the gap between the two adjacent railcars. A first end of a bridge plate may be attached to a body of a first railcar via a locking assembly while a second, opposite end of the bridge plate may be overlaid on a deck of a second railcar via. Coupling of two adjacent railcars via a pair of bridge plates is elaborated with reference to FIG. 12.

Based on usage of a bridge plate, the plate may be center-aligned, left-aligned, or right-aligned. The alignment of a bridge plate is characterized based on an alignment of a locking assembly coupled to the bridge plate. As an example, a system (e.g., product line) of bridge plates, may include: a first bridge plate assembly including a first bridge plate and a center-aligned locking assembly with a first pivot pin coupled to a center-aligned guide tube confined within a left edge and a right edge of the first bridge plate, a second bridge plate assembly including a second bridge plate and a left-aligned locking assembly with a second pivot pin coupled to a left-aligned guide tube protruding out of the left edge of the second bridge plate, and a third bridge plate assembly including a third bridge plate and a right-aligned locking assembly with a third pivot pin coupled to a right-aligned guide tube protruding out of the right edge of the third bridge plate. The center-aligned guide tube may be mounted on a first support bracket center aligned with the first bridge plate, the left-aligned guide tube may be mounted off-centered on a second support bracket center aligned with the second bridge plate, and the right-aligned guide tube may be mounted off-centered on a third support bracket center aligned with the third bridge plate. The second bridge plate may be coupled to a right edge of a gap between two railcars via engagement of a second locking pin with a first receiving port on a deck of a first railcar, and the third bridge plate may be coupled to a left edge of the gap via engagement of a third locking pin with a second receiving port on the first railcar. Details of bridge plates and associated locking assemblies are discussed in FIGS. 2-11.

Figure 2:
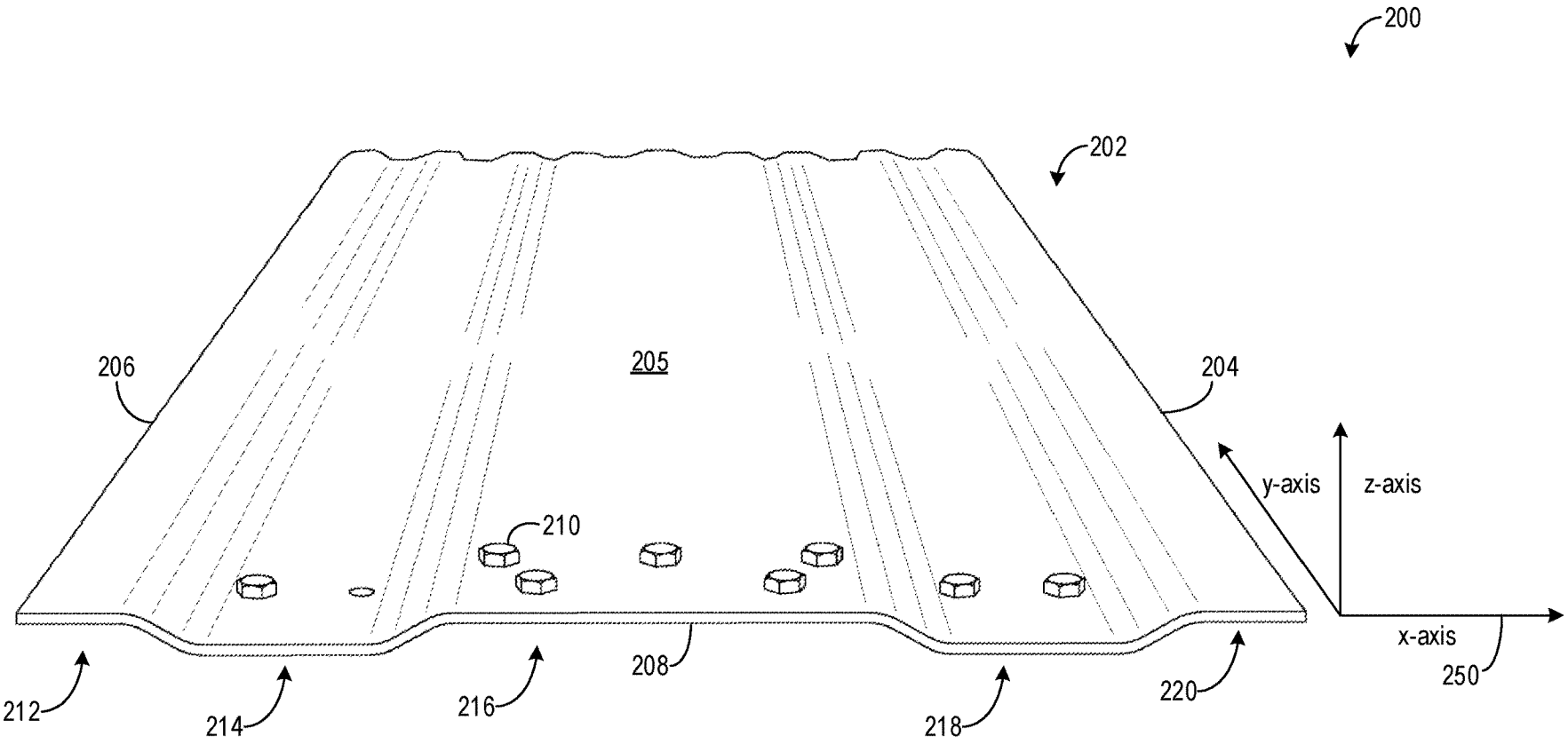
FIG. 2 shows a top perspective view of a first example railcar bridge plate.

FIG. 2 shows a top perspective view 200 of a first example railcar bridge plate 202. The bridge plate 202 may include two long sides 204 and 206 extending along the y-axis of a coordinate system 250 and two short parallel sides extending along the x-axis of the coordinate system 250. The bridge plate 202 may be positioned in a gap between two railcars with an upper surface 205 of the bridge plate facing upward, the upper surface 205 in face sharing contact with wheels of vehicles driven over it. In one example, the bridge plate may have a curved upper surface 205 with a series of crests and troughs such as alternating first crest 212, first trough 214, a central crest 216, a second trough 218, and a second crest 220. The central crest 216 may be wider than the adjacent crests and troughs. The curvature of the surface strengthens the bridge plate and facilitates alignment of the bridge plate on the portions of the railcar on which the bridge positioned. In another example, the bridge plate may have a flat surface.

A locking assembly (not shown in this figure) may be coupled to a lower surface (opposite to the upper surface 205) of the bridge plate proximal to a short side such as first side 208 of the bridge plate 202 via nuts and bolts or other fasteners 210. Any references to nuts and bolts herein also include the possibility of the use of other fasteners, such as rivets, or other fastening mechanisms such as welding. In the first bridge plate locking assembly, the locking assembly is center-aligned such that any component of the locking assembly does not protrude out of the long parallel sides 204 and 206. The locking assembly may extend parallel to the first side 208 along the x-axis.

Figure 3:
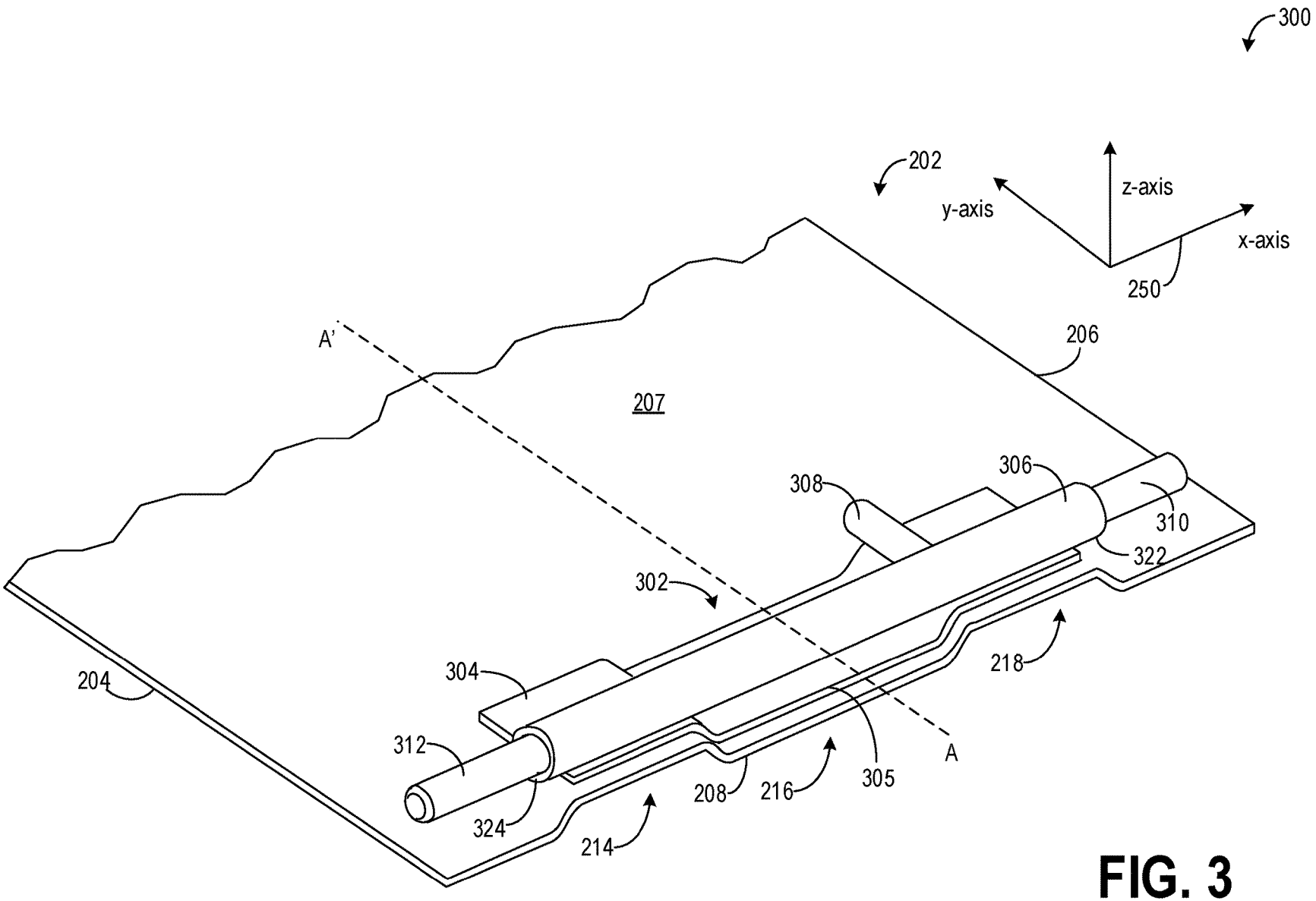
FIG. 3 shows a bottom perspective view of the first example railcar bridge plate including a first example car bridge plate locking assembly.

FIG. 3 shows a bottom perspective view 300 of the railcar bridge plate 202 including the first example bridge plate locking assembly 302. The bridge plate 202 may be positioned in a gap between two railcars with a lower surface 207 of the bridge plate facing downward, with the locking assembly 302 on the lower surface 207 coupled to the receiving port of a railcar.

The locking assembly 302 may be coupled to the lower surface 207 of the bridge plate 202 proximal to a first side 208 of the bridge plate 202. In the first bridge plate locking assembly, as shown in FIG. 3, the locking assembly 302 is center-aligned. The locking assembly may extend along the x-axis of a coordinate system 250. The locking assembly 302 may be mounted on an elongated support bracket 304 attached to the central portion such as center aligned with the central crest 216 and the central axis A-A' of the bridge plate 202. The surface of the support bracket 304 may be curved to imitate and align with the curvature of the bridge plate surface 207. As an example, the support bracket may have a flat surface with a depressed central portion 305. The support bracket 304 may be coupled to the bridge plate via a plurality of nuts and bolts.

A guide tube 306 may be coupled to a surface of the support bracket distal (not contacting) the bridge plate 202. The guide tube 306 may be a hollow tube with openings at a first end 322 and a second end 324. A slidable locking pin 310 may extend outward from the first end 322 of the guide tube 306 and a fixed pivot pin 312 may extend outward from the second end 324 of the guide tube 306. The locking pin 310 may protrude outward from the first end 322 while the pivot pin 312 may protrude outward from the second end 324. The locking pin 310 may be slidable within the hollow cavity of the guide tube 306. A handle 308 may be coupled to the locking pin 310 to slide the locking pin along the length of the guide tube 306 from a retracted position to an extended position. In the center-aligned locking assembly, as seen in FIG. 3, the guide tube 306 may be center aligned with a central axis A-A' and divided in half at the central axis A-A' with the locking pin 310 in the extended position. In the center-aligned locking assembly, an outer end of the locking pin 310 and an outer end of the pivot pin 312 may be equally spaced apart from the central axis A-A' and the respective outer ends of each of the locking pin 310 and the pivot pin 312 may be confined within the width of the bridge plate (such as between the long parallel sides 204 and 206). Details of the locking assembly 302 is further elaborated with relation to FIG. 4.

The locking assembly 302 may facilitate attachment of the railcar bridge plate 202 to a deck of a railcar. Receiving ports may be positioned at an end of the deck of the railcar. As an example, a set of receiving ports (such as two) may be present at the end of the railcar deck to receive first ends of two bridge plates; the other, second ends of the two bridge plates may be placed on the deck of the other railcar. Each receiving port may be a hollow, cylindrical tube configured and sized to receive a locking pin 310 of the locking assembly 302. To engage the locking assembly 302 to a receiving port of a railcar, the handle 308 may be actuated towards the receiving port to slide the locking pin 310 into the opening of the receiving port. To disengage the locking assembly, from the receiving port of the railcar, the handle 308 may be actuated away from the receiving port to slide the locking pin 310 out of the opening of the receiving port. The locking pin 310 may engaged to a receiving port on one end while the pivot pin 312 may be engaged to another receiving port (also referred herein as receiver) on an opposite end.

Figure 4:
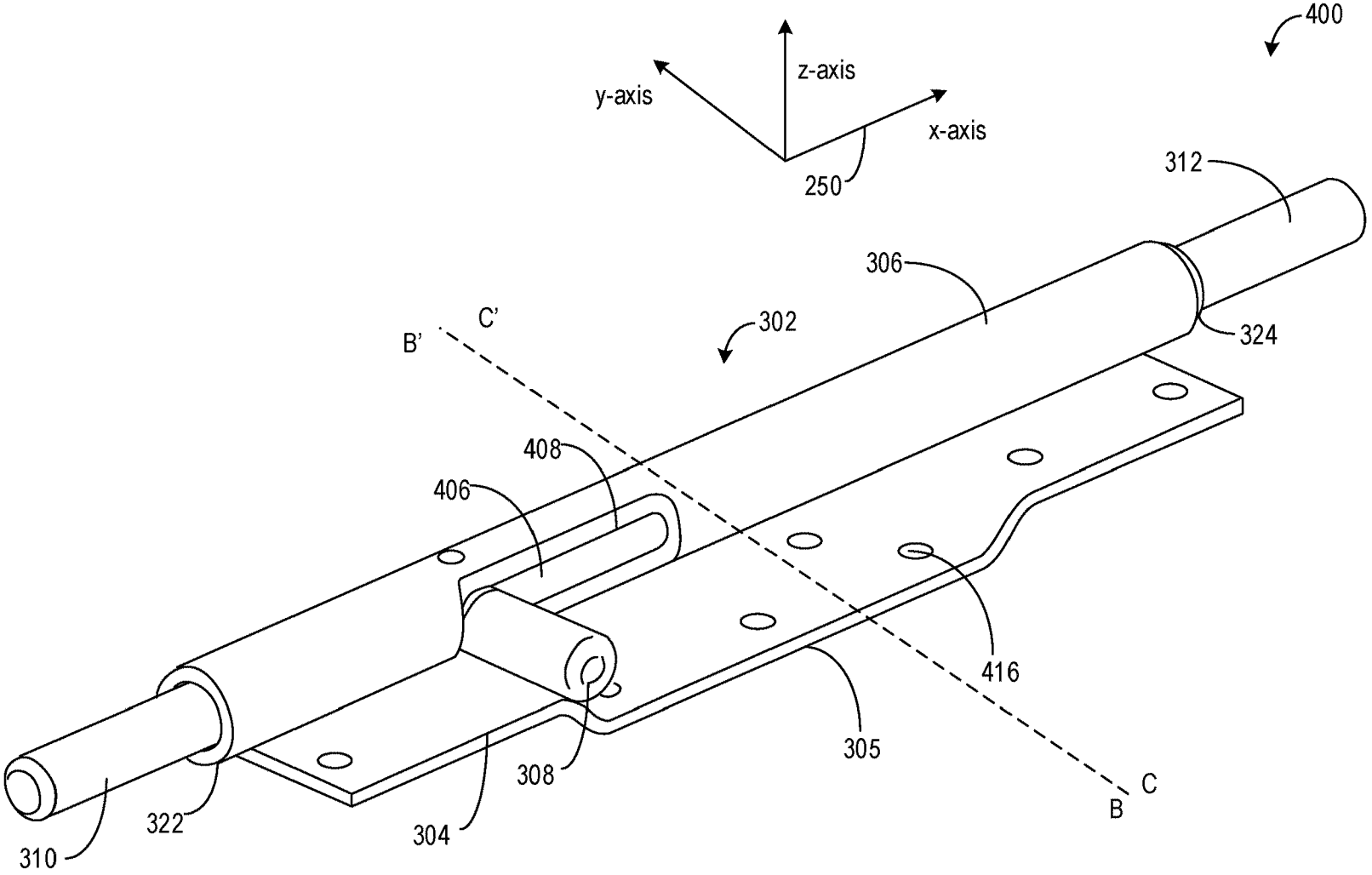
FIG. 4 shows the first example car bridge plate locking assembly.

FIG. 4 shows a perspective view 400 of the first example car bridge plate locking assembly 302 of FIG. 3. The locking assembly 302 may extend longitudinally along the x-axis of a coordinate system 250. The surface of the support bracket 304 may be curved to align with the curvature of the bridge plate surface on to which it is attached. As an example, the support bracket may have a flat surface with a depressed central portion 305. The support bracket 304 may be coupled to the bridge plate via a plurality of nuts and bolts passing through the plurality of openings 416 on the surface of the support bracket 304.

A guide tube 306 may be coupled to an upper surface of the support bracket 304 distal (not contacting) a bridge plate. In one example, a support block may be placed between an upper surface of the support bracket 304 and a lower surface of the guide tube 306 to support the guide tube.

The guide tube 306 may be a hollow cylindrical tube with openings at a first end 322 and a second end 324. A slidable locking pin 310 may extend outward from the first end 322 of the guide tube 306 towards the central axis B-B' of the support bracket 304 and a fixed pivot pin 312 may extend outward from the second end 324 of the guide tube 306.

The locking pin 310 may be slidable within the hollow cavity of the guide tube 306. The guide tube 306 may include openings at each of the first end 322, the second end 324 and a cylindrical lumen 408. The openings at the first end 322 and the cylindrical lumen 408 are configured and sized such that the locking pin 310 is freely movable within the guide tube 306. A handle 308 coupled to the locking pin 310 may be positioned within the opening 406 and the handle may be actuated to slide the locking pin along the opening 406. The handle 308 may be flush (in face sharing contact) with the surface of the support bracket 304 and movable between a first position and a second position. The curvature of the support bracket 304 allows for the handle to be flush with the support bracket 304 at the first position and to be moved along the depressed central portion 305 of the support bracket to reach the second position. The handle 308 may be counter bored so as to accept a socket head cap screw attaching the handle to the locking pin 310. A spring or other elastic element may be positioned within the hollow guide tube 306 between and abutting the fixed pivot pin 312 and the locking pin 310. The spring or other elastic element biases the locking pin in its fully extended position as shown in FIG. 4, to keep it engaged with a receiving port. To retract the locking pin inwards into the guide tube, the handle is pulled against the action of the spring or other elastic element; releasing the handle allows the spring or other elastic element to push the locking pin back out to its fully extended position. Thereby, the locking pin may be considered to be spring-loaded in the guide tube. (Any of the bridge plate assemblies as described herein may include a spring-loaded locking pin, in this manner.)

The support bracket on to which the locking assembly 302 is attached, the support bracket 304, the guide tube 306, the slidable locking pin 310, the removable handle 308, the fixed pivot pin 312 may all be made from a metal such as steel. However, one or more of these components of the locking assembly may be made from other suitable materials. Also, one or more of these components may be coated with a protective coating such as paint. One or more of these components may also be plated.

In the center-aligned locking assembly, as seen in FIG. 4, a central axis C-C' of the guide tube 306 may align with a central axis B-B' of the support bracket 304. Said another way, the guide tube may be center-aligned with the depressed central region 305 of the support bracket 304. Also, in the center-aligned locking assembly, an outer end of the locking pin 310 and an outer end of the pivot pin 312 may be equally spaced apart from the central axis B-B'.

Figures 5A, 5B, 5C, 5D:
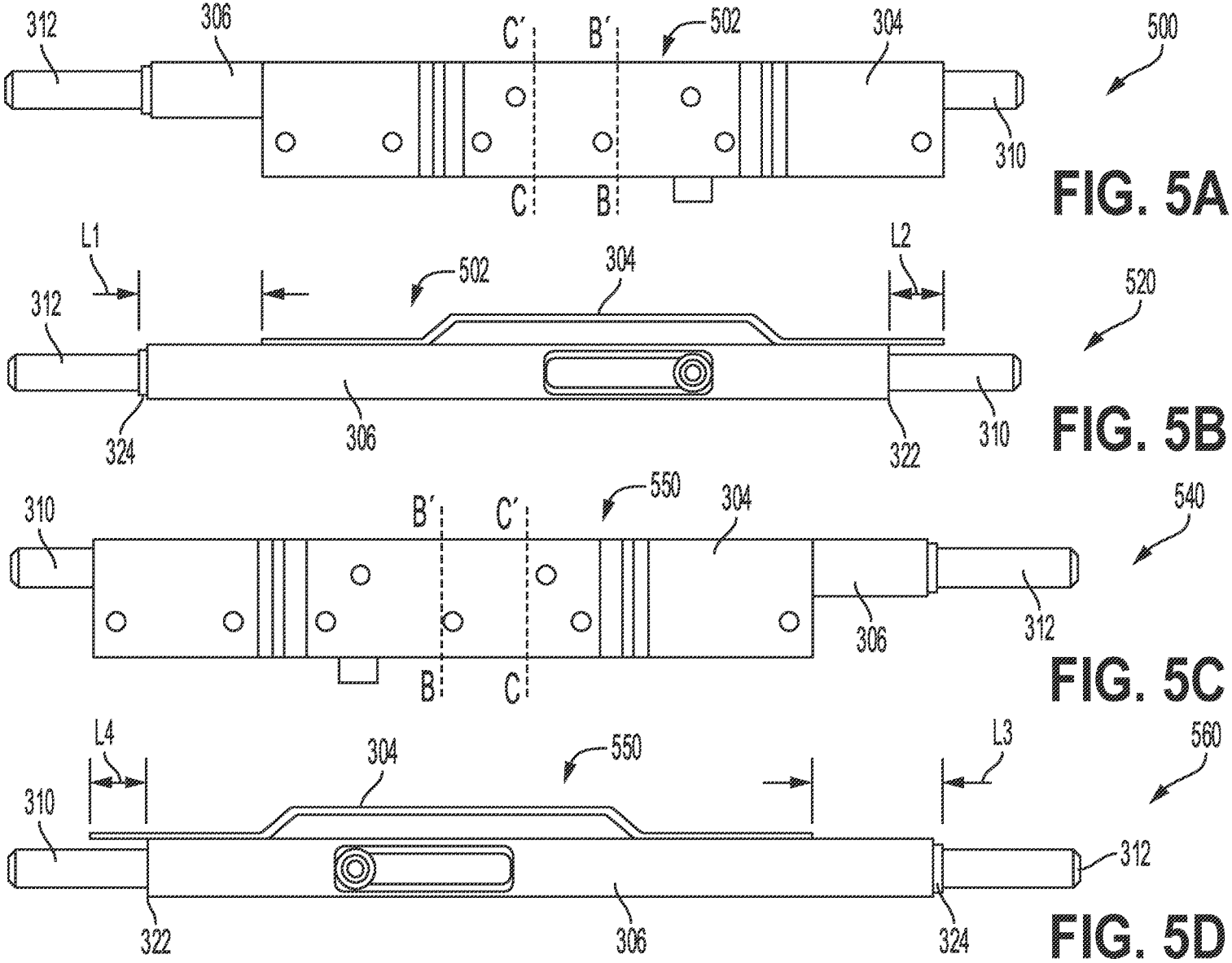
FIG. 5A shows a top view of a second example railcar bridge plate locking assembly.
FIG. 5B shows a front view of the second example railcar bridge plate locking assembly.
FIG. 5C shows a top view of a third example railcar bridge plate locking assembly.
FIG. 5D shows a front view of the third example railcar bridge plate locking assembly.

FIG. 5A shows a top view 500 of a second example railcar bridge plate locking assembly 502 and FIG. 5B shows a front view 520 of the second example railcar bridge plate locking assembly 502. The components of a locking assembly that have been previously introduced and described are not reintroduced. The second railcar bridge plate locking assembly 502 is a left-aligned locking assembly. In the left-aligned locking assembly 502, a central axis C-C' of the guide tube 306 may be to the left of a central axis B-B' of the support bracket 304. Said another way, the guide tube may be shifted left relative to the center of the support bracket 304. Due to shifting of the guide tube 306 to the left, at least a portion of the guide tube 306 (such as the second end 324) along with the pivot pin 312 may protrude outside the edge of the support bracket 304 and at least a portion of the support bracket 304 may overhang beyond the first end 322 of the guide tube 306.

The distance between the left edge of the support bracket 304 and the second end 324 of the guide tube 306 may be denoted by L1 and the distance between the right edge of the support bracket 304 and the first end 322 of the guide tube 306 may be denoted by L2. In one example, L1 may be in the range of 2.5 and 3.0 inches. In another example, L2 may be in the range of 1.0 and 1.5 inches. Due to the left alignment of the locking assembly 502, an outer end of the pivot pin 312 and an outer end of the locking pin 310 may no longer be equally spaced apart from the central axis B-B' of the support bracket 304. The distance between the pivot pin 312 and the central axis B-B' of the support bracket 304 may be higher relative to the distance between the locking pin 310 and the central axis B-B' of the support bracket 304. A left-aligned locking assembly is further described in relation to FIGS. 7-8.

FIG. 5C shows a top view 540 of a third example railcar bridge plate locking assembly 550 and FIG. 5D shows a front view 560 of the third example railcar bridge plate locking assembly 550. The right-aligned locking assembly 550 may be a mirror-image of the left-aligned locking assembly 502 in FIGS. 5A-B. The components of a locking assembly that have been previously introduced and described are not reintroduced. The third railcar bridge plate locking assembly 550 is a right-aligned locking assembly. In the right-aligned locking assembly 550, a central axis C-C' of the guide tube 306 may be to the right of a central axis B-B' of the support bracket 304. Said another way, the guide tube may be shifted right relative to the center of the support bracket 304. Due to shifting of the guide tube 306 to the right, at least a portion of the guide tube 306 (such as the second end 324) along with the pivot pin 312 may protrude outside the edge of the support bracket 304 and at least a portion of the support bracket 304 may overhang beyond the first end 322 of the guide tube 306.

The distance between the right edge of the support bracket 304 and the second end 324 of the guide tube 306 may be denoted by L3 and the distance between the left edge of the support bracket 304 and the first end 322 of the guide tube 306 may be denoted by L4. In one example, L3 may be in the range of 2.5 and 3.0 inches. In another example, L4 may be in the range of 1.0 and 1.5 inches. Due to the right alignment of the locking assembly 550, an outer end of the locking pin 310 and an outer end of the pivot pin 312 may no longer be equally spaced apart from the central axis B-B' of the support bracket 304. The distance between the pivot pin 312 and the central axis B-B' of the support bracket 304 may be higher relative to the distance between the locking pin 310 and the central axis B-B' of the support bracket 304. A right-aligned locking assembly is further described in relation to FIGS. 10-11.

Figure 6:
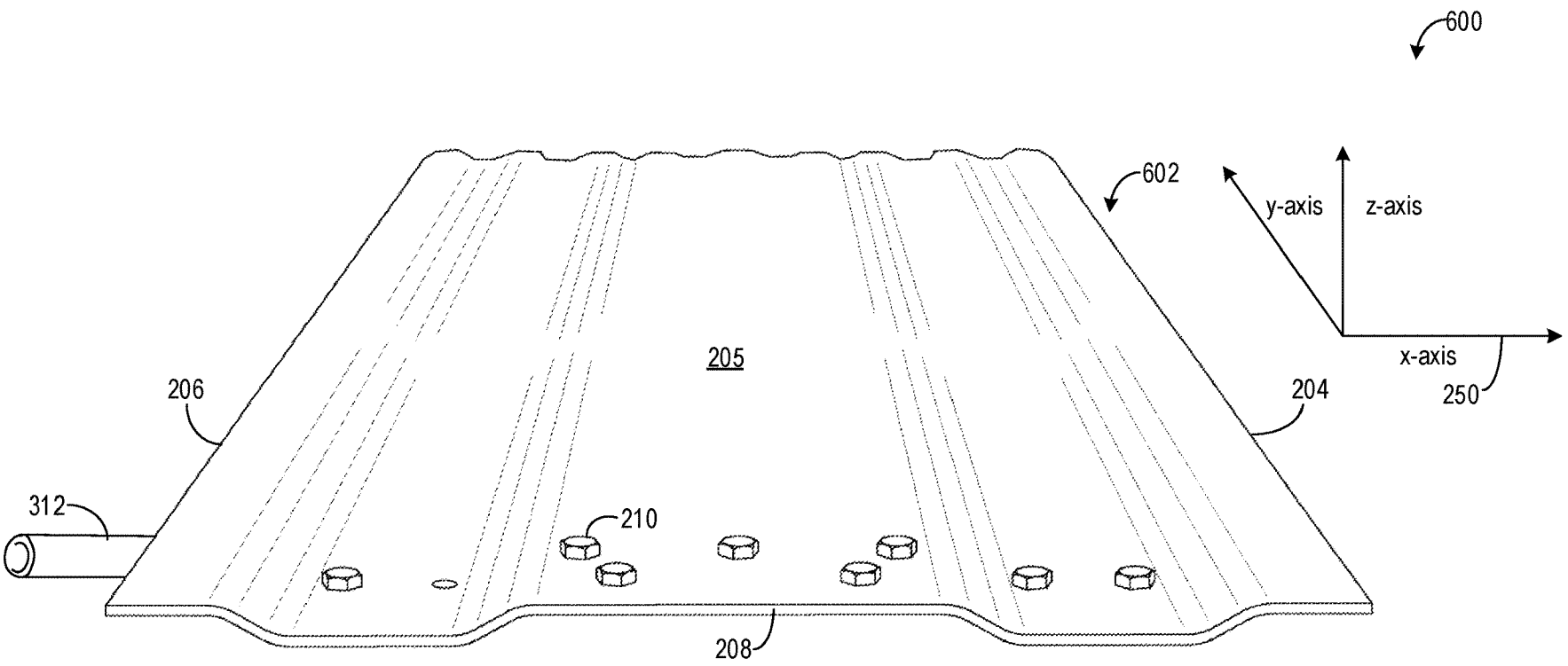
FIG. 6 shows a top perspective view of a second example railcar bridge plate.

FIG. 6 shows a top perspective view 600 of a second example left-aligned railcar bridge plate 602 including the second example car bridge plate locking assembly of FIGS. 5A-B. The bridge plate 602 in FIG. 6 may be identical to the bridge plate 202 in FIG. 2, therefore the components are not reiterated.

A locking assembly may be coupled to an opposite lower surface of the bridge plate proximal to a short side such as first side 208 of the bridge plate 602 via nuts and bolts 210. In the second bridge plate locking assembly, the locking assembly is left-aligned such that the pivot pin 312 may protrude out of the left side 206. The locking assembly may extend parallel to the first side 208 along the x-axis. The pivot pin 312 may be engaged to a receiving port at an end of a railcar deck to which the bridge plate 602 is attached. The left-aligned bridge plate 602 may be attached to a right side of a gap between two adjacent railcars via a locking pin. Due to the protrusion of the pivot pin 312, the bridge plate 602 may be moved further right of the gap.

Figure 7:
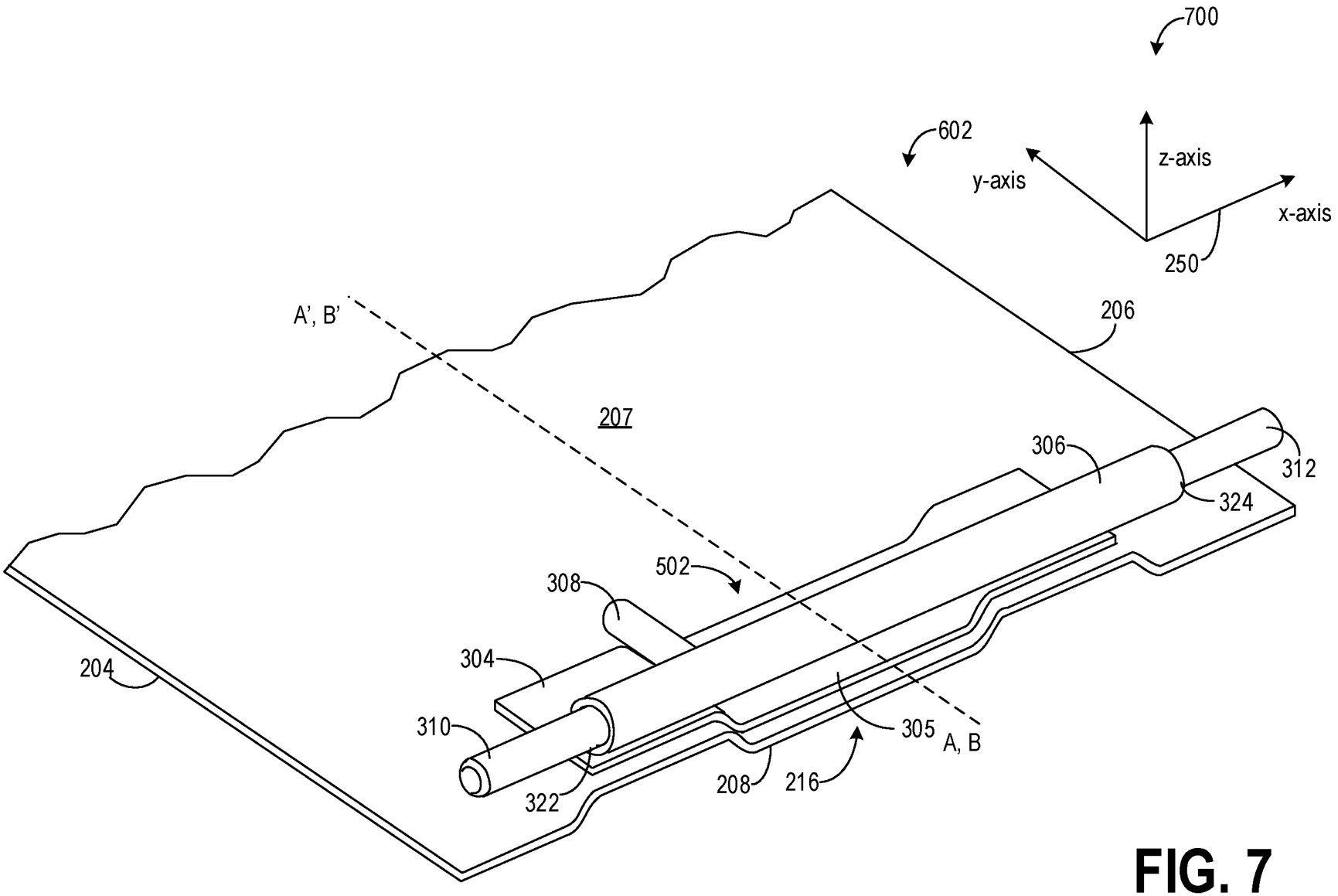
FIG. 7 shows a bottom perspective view of the second example railcar bridge plate including a second example car bridge plate locking assembly.

FIG. 7 shows a bottom perspective view 700 of the railcar bridge plate 602 including the second example car bridge plate locking assembly of FIGS. 5A-B. The bridge plate 602 in FIG. 6 may be identical to the bridge plate 202 in FIG. 3, therefore the components are not reiterated.

The locking assembly 502 may be coupled to the lower surface 207 of the bridge plate 602 proximal to the first side 208. In the second bridge plate locking assembly, as shown in FIG. 6, the locking assembly 502 is left-aligned. The locking assembly 502 may extend along the x-axis of a coordinate system 250. The locking assembly 502 may be mounted on an elongated support bracket 304 attached to the central portion such as center aligned with the central crest 216 and the central axis A-A' of the bridge plate 602. The central axis A-A' of the bridge plate 602 may align with the central axis B-B' of the support bracket 304. The position of the support bracket 304 relative to the bridge plate 602 does not change between a center-aligned locking assembly (as seen in FIG. 7) and a left-aligned locking assembly 502. The surface of the support bracket 304 may be curved to imitate and align with the curvature of the bridge plate surface 207. The support bracket 304 may be coupled to the bridge plate via a plurality of nuts and bolts.

A guide tube 306 may be coupled to a surface of the support bracket distal (not contacting) the bridge plate 602. A pivot pin 312 may extend outward from the second end 324 of the guide tube 306 away from the central axis A-A' and a slidable locking pin 310 may extend outward from the first end 322 of the guide tube 306 away from the central axis A-A'. The locking pin 310 may be slidable within the hollow cavity of the guide tube 306. A handle 308 may be coupled to the locking pin 310 to slide the locking pin along the length of the guide tube 306 from a retracted position to an extended position. The handle 308 may be flush (in face sharing contact) with the surface of the support bracket 304 and movable between a first position (locking pin 310 fully extended) and a second position (locking pin 310 fully retracted). The curvature of the support bracket 304 allows for the handle to be flush with the support bracket 304 at the first position and to be moved along the depressed central portion 305 of the support bracket to reach the second position. In the left-aligned locking assembly, as seen in FIG. 7, the guide tube 306 may be left aligned relative to the central axis B-B' of the support bracket 304 and divided unequally at the central axis A-A'. In the left-aligned locking assembly, an outer end of the locking pin 310 and an outer end of the pivot pin 312 may be unequally spaced apart from the central axis A-A' with the outer end of the pivot pin 312 protruding out of the bridge plate and the outer end of the locking pin 310 being confined within the width of the bridge plate (such as between the long parallel sides 204 and 206). Details of the locking assembly 502 is further elaborated with relation to FIG. 8. Due to the protrusion of the pivot pin 312 out of the left side of the bridge plate, upon coupling of the locking pin 310 to a receiving port of a railcar and upon engagement of the pivot pin 312 to another receiving port on the railcar deck, the bridge plate may be shifted outward to the right.

Figure 8:
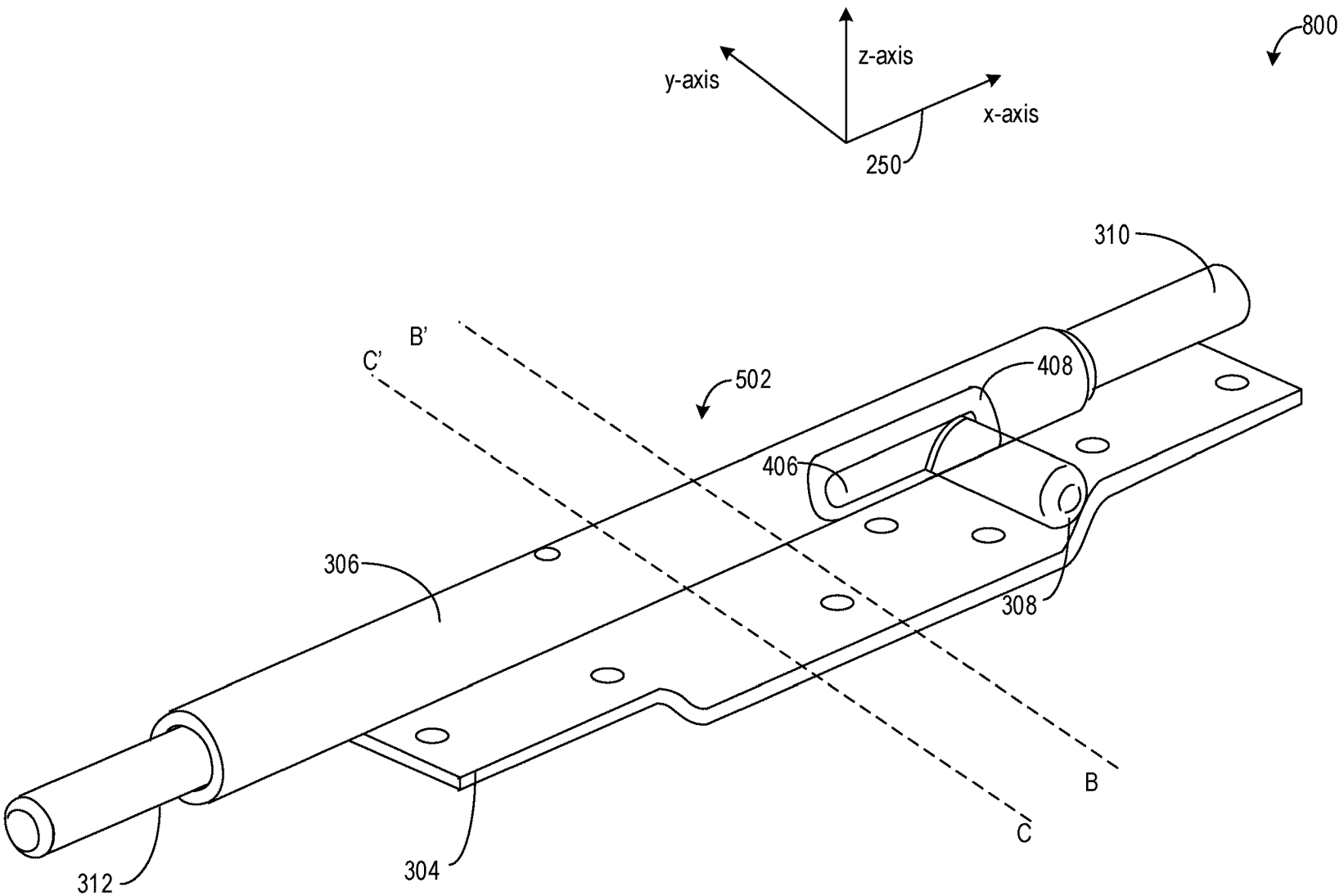
FIG. 8 shows a perspective view of the second example car bridge plate locking assembly.

FIG. 8 shows a perspective view 800 of the second example car bridge plate locking assembly 502 of FIG. 7. Components of the locking assembly 502 in FIG. 8 that are identical to the corresponding components of the locking assembly 302 in FIG. 4 are not re-introduced.

A guide tube 306 may be coupled to an upper surface of the support bracket 304 distal (not contacting) a bridge plate. In the left-aligned locking assembly, as seen in FIG. 8, a central axis C-C' of the guide tube 306 may not align with a central axis B-B' of the support bracket 304. The guide tube may be shifted to the left with respect to the central axis B-B' of the support bracket. While the support bracket 304 may be attached to a same position on the bridge plate such as center aligned with the support bracket, the attachment of the guide tube 306 may be modified by shifting the guide tube 306 to the left compared to a center-aligned locking assembly. Due to the left-alignment of the guide tube 306, an outer end of the pivot pin 312 and an outer end of the locking pin 310 may be unequally spaced apart from the central axis B-B'. The pivot pin 312 may protrude further out of the left edge of the support bracket 304 relative to the level of protrusion of the locking pin 310 from the right edge of the support bracket 304.

Figure 9:
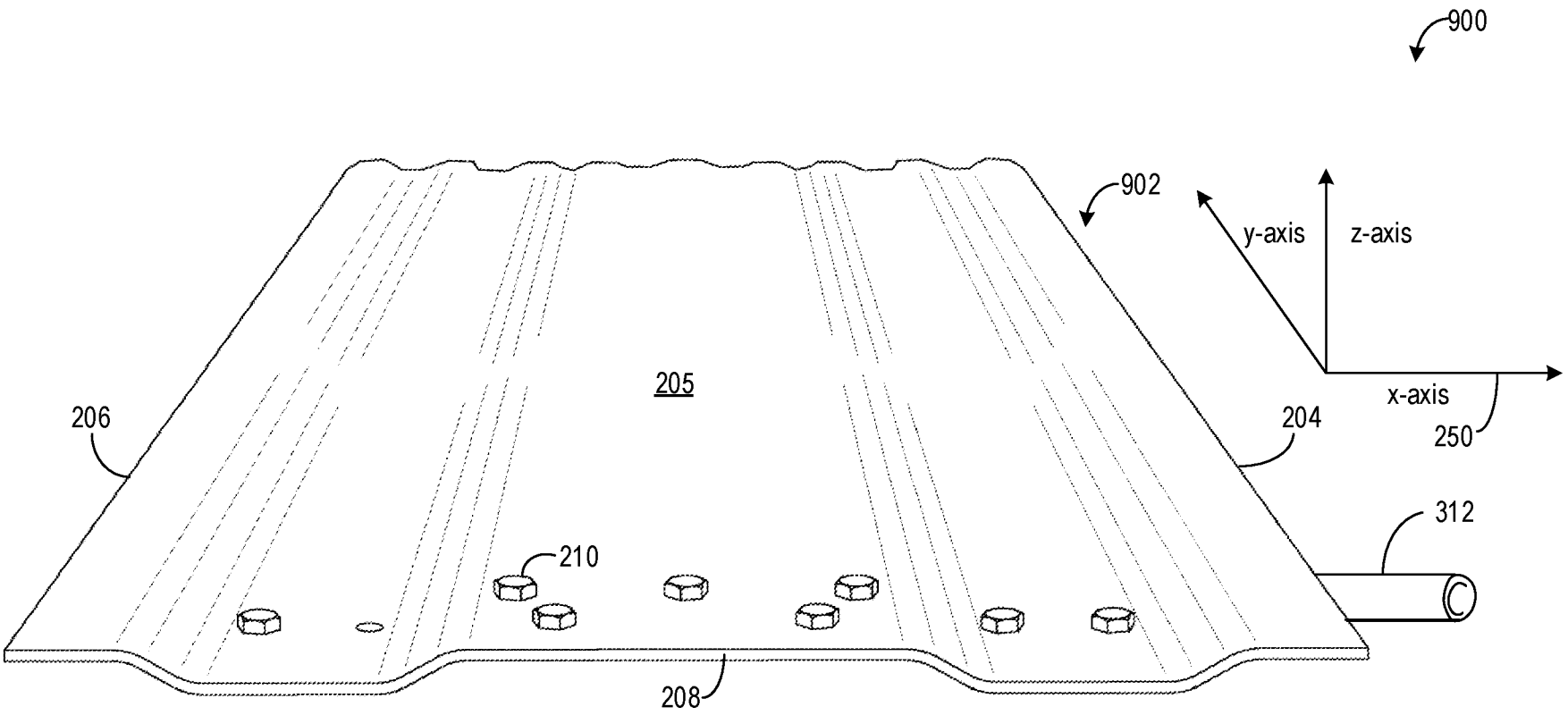
FIG. 9 shows a top perspective view of a third example railcar bridge plate.

FIG. 9 shows a top perspective view 900 of a third example right-aligned railcar bridge plate 902 including the third example car bridge plate locking assembly of FIGS. 5C-D. The bridge plate 902 in FIG. 6 may be identical to the bridge plate 202 in FIG. 2, therefore the components are not reiterated.

A locking assembly may be coupled to an opposite lower surface of the bridge plate proximal to a short side such as first side 208 of the bridge plate 902 via nuts and bolts 210. In the third bridge plate locking assembly, the locking assembly is right-aligned such that the pivot pin 312 may protrude out of the right side 204. The locking assembly may extend parallel to the first side 208 along the x-axis. The pivot pin 312 may be engaged to a receiving port of a railcar deck to which the bridge plate 902 is attached. The right-aligned bridge plate 902 may be attached to a left side of a gap between two adjacent railcars via a locking pin. Due to the protrusion of the pivot pin 312, the bridge plate 902 may be moved outward further to the left of the gap.

Figure 10:
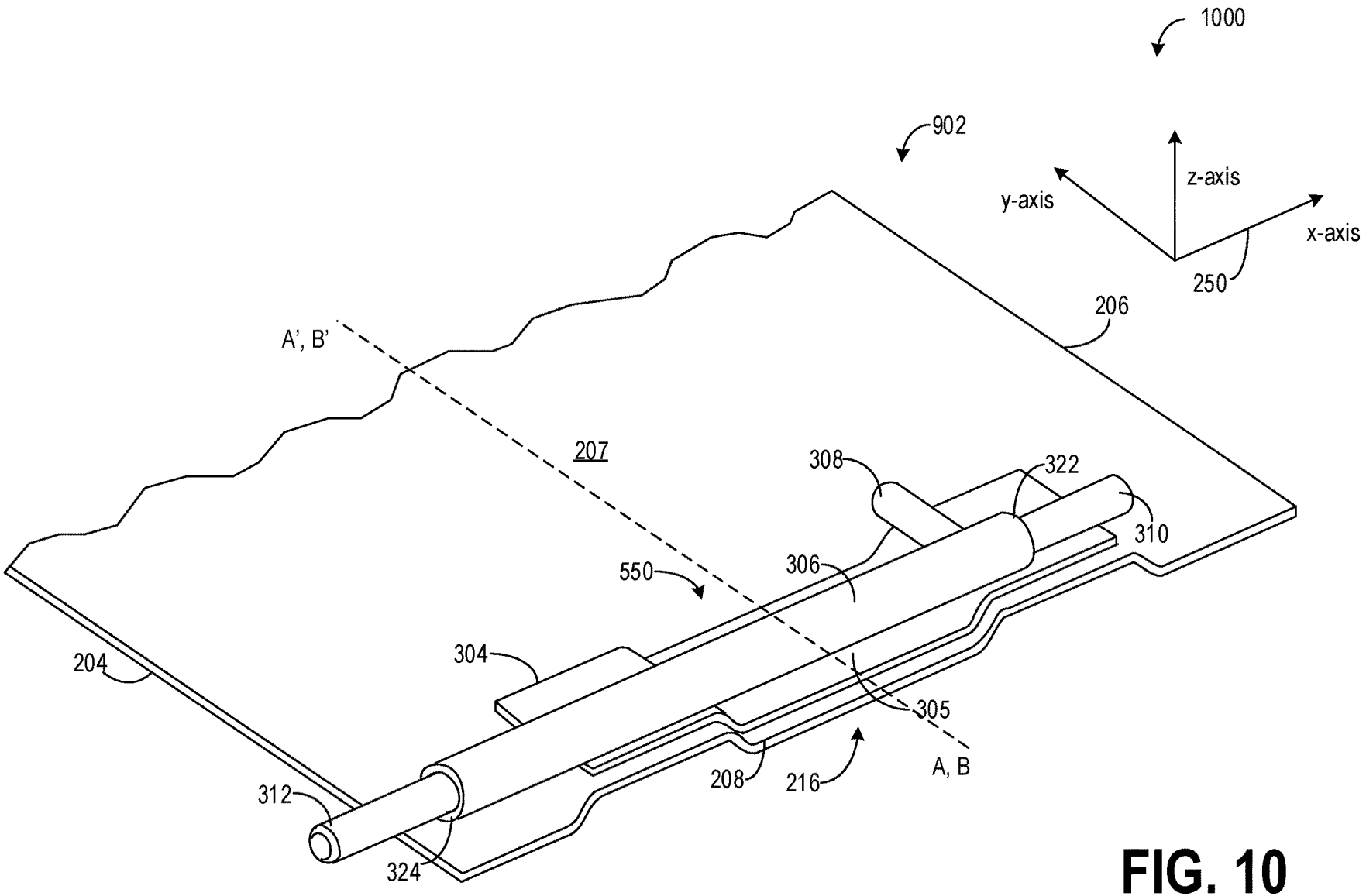
FIG. 10 shows a bottom perspective view of the third example railcar bridge plate including a third example car bridge plate locking assembly.

FIG. 10 shows a bottom perspective view 1000 of the railcar bridge plate 902 including the third example car bridge plate locking assembly of FIGS. 5C-D. The bridge plate 902 in FIG. 10 may be identical to the bridge plate 202 in FIG. 3, therefore the components are not reiterated.

The locking assembly 550 may be coupled to the lower surface 207 of the bridge plate 902 proximal to first side 208 of the bridge plate 902. In the third bridge plate locking assembly, as shown in FIG. 9, is right-aligned. The right-aligned locking assembly 550 may be a mirror-image of the left-aligned locking assembly 502 in FIG. 7 and all components of the two locking assemblies 502 and 550 may exhibit mirror symmetry.

The locking assembly 550 may extend along the x-axis of a coordinate system 250. The locking assembly 550 may be mounted on an elongated support bracket 304 attached to the central portion such as center aligned with the central crest 216 and the central axis A-A' of the bridge plate 902. The central axis A-A' of the bridge plate 902 may align with the central axis B-B' of the support bracket 304. The position of the support bracket 304 relative to the bridge plate 902 does not change between a center-aligned locking assembly (as seen in FIG. 7) and a right-aligned locking assembly 550. The surface of the support bracket 304 may be curved to imitate and align with the curvature of the bridge plate surface 207. The support bracket 304 may be coupled to the bridge plate via a plurality of nuts and bolts.

A guide tube 306 may be coupled to a surface of the support bracket distal (not contacting) the bridge plate 902. A pivot pin 312 may extend outward from the second end 324 of the guide tube 306 and a slidable locking pin 310 may extend outward from the first end 322 of the guide tube 306. The locking pin 310 may be slidable within the hollow cavity of the guide tube 306. A handle 308 may be coupled to the locking pin 310 to slide the locking pin along the length of the guide tube 306 from a retracted position to an extended position. In the right-aligned locking assembly, as seen in FIG. 10, the guide tube 306 may be right aligned relative to the central axis B-B' of the support bracket 304 and divided unequally at the central axis A-A'. In the right-aligned locking assembly, with the pivot pin 312 in the extended position, an outer end of the pivot pin 312 and an outer end of the locking pin 310 may be unequally spaced apart from the central axis A-A' with the outer end of the pivot pin 312 protruding out of the bridge plate and the outer end of the locking pin 310 being confined within the width of the bridge plate (such as between the long parallel sides 204 and 206). Details of the locking assembly 550 are further elaborated with relation to FIG. 11. Due to the protrusion of the pivot pin 312 out of the right side of the bridge plate, upon and upon engagement of the pivot pin 312 to a receiving port on the railcar deck, the bridge plate may be shifted outward to the left.

Figure 11:
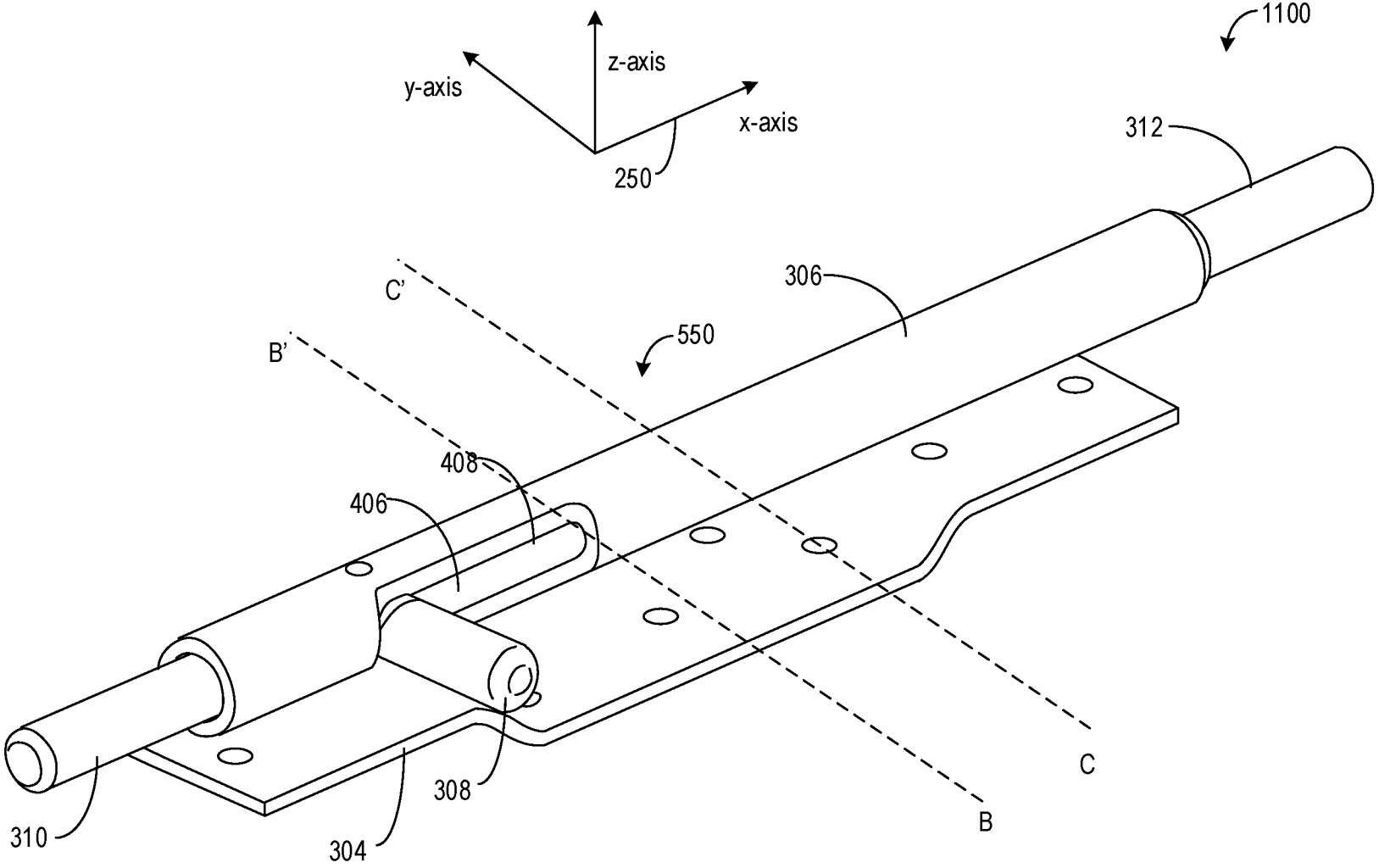
FIG. 11 shows the third example car bridge plate locking assembly.

FIG. 11 shows a perspective view 1100 of the third example car bridge plate locking assembly 550 of FIG. 10. Components of the locking assembly 550 in FIG. 11 that are identical to the corresponding components of the locking assembly 302 in FIG. 4 are not re-introduced. The right-aligned locking assembly 550 may be a mirror-image of the left-aligned locking assembly 502 in FIG. 8 and all components of the two locking assemblies 502 and 550 may exhibit mirror symmetry.

A guide tube 306 may be coupled to an upper surface of the support bracket 304 distal (not contacting) a bridge plate. In the right-aligned locking assembly, as seen in FIG. 11, a central axis C-C' of the guide tube 306 may not align with a central axis B-B' of the support bracket 304. The guide tube 306 may be shifted to the right with respect to the central axis B-B' of the support bracket. While the support bracket 304 may be attached to a same position on the bridge plate such as center aligned with the support bracket, the attachment of the guide tube 306 may be modified by shifting the guide tube 306 to the right compared to a center-aligned locking assembly. Due to the right-alignment of the guide tube 306, an outer end of the pivot pin 312 and an outer end of the locking pin 310 may be unequally spaced apart from the central axis B-B'. The pivot pin 312 may protrude further out of the right edge of the support bracket 304 relative to the level of protrusion of the locking pin 310 from the left edge of the support bracket 304.

FIG. 12 shows a schematic 1200 of an example coupling of a pair of railcar bridge plates in a gap between two adjacent railcars. A first, right-aligned, bridge plate 1210 and a second, left-aligned bridge plate 1212 may be used to couple a first railcar 1202 to a second railcar 1204. Vehicles may be transported from one location to another (such as from a manufacturing facility to a distribution destination) via a string or series of connected railcars. The vehicles may be loaded/unloaded at one end of the string or series of connected railcars.

During loading/unloading, the vehicles are transported (such as driven) between two adjacent railcars such as the first railcar 1202 and the second railcar 1204 over a gap 1203 at the junction between the two adjacent railcars. The two bridge plates 1210 and 1212 bridge the gap 1203 between the two adjacent railcars and allow the vehicles to be driven from one railcar to the next via the bridge plates. In one example, during loading, a series of vehicles may be driven from the first railcar 1202 to the second railcar 1204 with their wheels travelling over each of the first bridge plate 1210 and the second bridge plate 1212.

In one example (as seen in FIG. 12), each of the bridge plate 1210 and the second bridge plate 1212 may include a locking assembly attached to one end of the respective bridge plate. The ends of the bridge plates with the locking assemblies may be coupled to a deck of a first railcar while the other end may be placed above the body of the deck of the second railcar, thereby bridging the gap between the two railcars.

For the left-aligned bridge plate 1210, such as a left-aligned bridge plate in FIG. 7, a left-aligned locking assembly, such as left-aligned locking assembly in FIG. 8, may be attached at one end. In a left-aligned bridge plate, a pivot pin may protrude out of the left edge of the bridge plate. In this example, a first pivot pin 1222 may protrude out (to the left) of a first locking assembly coupled to a first end of the first bridge plate 1210. A second pivot pin 1218 may protrude out (to the right) of a second locking assembly coupled to a first end of the second, right-aligned, bridge plate 1212. The first pivot pin 1222 may engage (such as abut) with a second receiving port 1220 coupled to a right side of deck of the first railcar 1202 facing the second railcar 1204 and the second pivot pin 1218 may engage with a fourth receiving port 1216 coupled to a left side of deck of the first railcar 1202 facing the second railcar 1204. Due to the pivot pins 1222 and 1218 jutting out of the respective bridge plates, upon engaging the pivot pins to the respective receiving ports, the first bridge plate 1210 is shifted outward (towards right) away from the central axis G-G' and the second bridge plate 1212 is shifted outward (towards left) away from the central axis G-G' of the gap 1203.

The first locking pin (not shown) coupled to the first locking assembly of the first bridge plate 1210 may be inserted into a first receiving port 1234 coupled to a right side of the deck of the first railcar 1202. The second locking pin (not shown) coupled to the second locking assembly of the second bridge plate 1212 may be inserted into a third receiving port 1232 coupled to a left side of a deck of the first railcar 1202. The second receiving port 1220 and the first receiving port 1234 may be on either side of the first bridge plate 1210 while the fourth receiving port 1216 and the third receiving port 1232 may be on either sides of the second bridge plate 1212.

In contrast, if instead of using right-aligning and left-aligning bridge plates, center-aligned bridge plates were used to bridge the gap 1203 between the adjacent railcars, the first pivot pin 1222 and the second pivot pin 1218 would not have been protruding outwards from the central axis G-G'. Dashed line 1214 shows a first center-aligned bridge plate used instead of a right-aligned first bridge plate 1210 and dashed line 1213 shows a second center-aligned bridge plate used instead of a left-aligned second bridge plate 1212.

The distance between the inner edges of the first right-aligned bridge plate 1210 and the second left-aligned bridge plate 1212 is denoted by I2 and the distance between the outer edges of the first right-aligned bridge plate 1210 and the second left-aligned bridge plate 1212 is denoted by O2. The distance between the inner edges of the alternate first center-aligned bridge plate 1214 and the alternate second left-aligned bridge plate 1213 is denoted by I1 and the distance between the outer edges of the alternate first center-aligned bridge plate 1214 and the alternate second left-aligned bridge plate 1213 is denoted by O1. It is observed that O2 is greater than O1, thereby confirming that by using left-aligned and right aligned bridge plates instead of center aligned bridge plates, the distance between the outer edges of the bridge plates may be increased. Also, it is observed that I2 is greater than I1, thereby confirming that by using left-aligned and right aligned bridge plates instead of center aligned bridge plates, the distance between the inner edges of the bridge plates may be increased. By using left-aligned and right-aligned bridge plates instead of center aligned bridge plates, an increase of 3-7 inches may be attained for the distance between two inner/outer edges of the bridge plates. In one example, I1 may be 42 inches, O1 may be 85 inches while I2 may be 46.5 inches, and O2 may be 90 inches. Therefore, it is possible to drive a vehicle with a wheel base width between 46.5 inches to 90 inches over the parallelly placed bridge plates. By increasing the distance between the outer edges, it is possible to accommodate vehicles with wider wheel bases without having to actually change the dimensions of the bridge plates. As an example, a heavy duty dually wheels truck such as a RAM truck with a wide wheel base of 84.75 inches may be driven between two aligned railcars via the left and right aligned bridge plates. Further, the distance between the inner edges of two parallelly placed bridge plates may remain sufficient to support vehicles with narrower wheel bases.

FIG. 13 shows an example 1300 of a pair of railcar bridge plates that may be used together to bridge a gap between two adjacent railcars. A first bridge plate 1320 may be a right-aligned bridge plate with a right-aligned locking assembly 1322 coupled at one end. The right-aligned locking assembly 1322 may include a first pivot pin 1326 protruding to the right of the bridge plate 1320. During coupling of the bridge plates to the junction between two railcars, the first bridge plate 1320 may be placed to the left of the gap between two railcars and a first locking pin 1332 may be used to secure the bridge plate to one side of a railcar. A second bridge plate 1310 may be a left-aligned bridge plate with a left-aligned locking assembly 1313 coupled at one end. The left-aligned locking assembly 1313 may include a second pivot pin 1316 protruding to the left of the bridge plate 1310. During coupling of the bridge plates to the junction between two railcars, the second bridge plate 1310 may be placed to the right of the gap between two railcars and a second locking pin 1334 may be used to secure the bridge plate to another side of a railcar. In one example, when placed between two railcars, the first pivot pin 1326 may face the second pivot pin 1316. In another example, when the right-aligned locking assembly is not a mirror-image of the left-aligned locking assembly, the first pivot pin 1326 may not face the second pivot pin 1316. In one example, the bridge plates may be color coded for immediate recognition during attachment of the bridge plates between the railcars. In this example, the right-aligned bridge plate may be color coded with a green locking assembly while the left-aligned bridge plate may be color coded with a red locking assembly.

FIG. 14A shows an example attachment 1400 of a right-aligned bridge plate 1440 to a receiving port 1448 of a railcar deck. A pivot pin 1446 protruding out of the right edge of the bridge plate 1440 may be engaged with a hollow, cylindrical receiving port 1448 attached to an edge of the railcar deck facing the bridge plate.

FIG. 14B shows an example attachment 1450 of a left-aligned bridge plate 1410 to a receiving port 1418 of a railcar deck. A pivot pin 1416 protruding out of the left edge of the bridge plate 1410 may be engaged with a hollow, cylindrical receiving port 1418 attached to an edge of the railcar deck facing the bridge plate.

FIG. 15 shows an example 1500 of a vehicle 1502 being transferred between a first railcar 1506 and a second railcar 1508 using bridge plates. The first railcar 1506 may be aligned to the second railcar 1508. A first left-aligned bridge plate 1520 may be positioned on one side of the gap between the first railcar 1506 and the second railcar 1508, while a second right-aligned bridge plate 1510 may be positioned on another, opposite side of the gap between the first railcar 1506 and the second railcar 1508. A vehicle may be transferred from the first railcar 1506 to the second railcar 1508 by driving the wheels of the vehicle over the bridge plates. The distance between the two parallelly placed bridge plates may be optimal to support vehicles with different wheel base sizes.

In this way, a first, left-aligned bridge plate may be attached to a right side of a gap between a first railcar and a second railcar by engaging a left-aligned pivot pin protruding from a left edge of the first bridge plate with a second receiving port of the first railcar and a left-aligned locking pin with a first receiving port of the first railcar, the left-aligned pivot pin coupled within a left-aligned hollow guide tube mounted on a first support bracket. A second, right-aligned bridge plate may be attached to a left side of the gap by engaging a right-aligned pivot pin protruding from a right edge of the second bridge plate with a fourth receiving port of the first railcar and a right-aligned locking pin with a third receiving port of the first railcar, the right-aligned pivot pin coupled within a right-aligned hollow guide tube mounted on second centered support bracket.

An example system for a bridge plate assembly comprises: a bridge plate; and a locking assembly comprising a guide tube holding a pivot pin, wherein the locking assembly has a center shifted to a side from a center of the bridge plate. In the preceding example, additionally or optionally, the locking assembly further comprises a support bracket coupled to the guide tube, a central axis of the support bracket aligned with the center of the bridge plate, and wherein the guide tube comprises an elongated hollow tube with the pivot pin protruding out of one end of the guide tube and a locking pin protruding out of another, opposite end of the guide tube. In any or all of the preceding examples, additionally or optionally, the bridge plate is configured to be coupled at least at one end to a first receiving port of a dock of a railcar to span a gap between the railcar and an adjacent railcar. In any or all of the preceding examples, additionally or optionally, the bridge plate is configured to be coupled at least at the one end to a second receiving port of the dock of the railcar, the first receiving port and the second receiving port positioned on opposite sides of the bridge plate. In any or all of the preceding examples, additionally or optionally, the first receiving port is one of a first, left receiving port coupled to a left side of the dock proximal to the bridge plate assembly and a third, right receiving port coupled to a right side of the dock proximal to the bridge plate assembly, and wherein the second receiving port is one of a second, left receiving port coupled to the left side of the dock proximal to the bridge plate assembly and a fourth, right receiving port coupled to the right side of the dock proximal to the bridge plate assembly. In any or all of the preceding examples, additionally or optionally, the pivot pin with the center shifted to a left side from the center of the bridge plate is a first pivot pin and the bridge plate assembly with the first pivot pin shifted to the left side is a left-aligned bridge plate assembly, the first pivot pin engaged to the second, left receiving port and a first locking pin of the left-aligned bridge plate assembly inserted into the first, left receiving port. In any or all of the preceding examples, additionally or optionally, the pivot pin with the center shifted to a right side from the center of the bridge plate is a second pivot pin and the bridge plate assembly with the second pivot pin shifted to the right side is a right-aligned bridge plate assembly, the second pivot pin engaged to the fourth, right receiving port and a second locking pin of the right-aligned bridge plate assembly inserted into the third, right receiving port. In any or all of the preceding examples, additionally or optionally, the left-aligned bridge plate assembly is placed along a right edge of the gap between two adjacent railcars and wherein the right-aligned bridge plate assembly is placed along a left edge of the gap between two adjacent railcars, a left-aligned bridge plate parallel to a right-aligned bridge plate. In any or all of the preceding examples, additionally or optionally, a distance between outer edges of the left-aligned bridge plate parallel and the right-aligned bridge plate is in a range of 86-92 inches, and wherein a distance between inner edges of the left-aligned bridge plate parallel and the right-aligned bridge plate is in a range of 41-47 inches. In any or all of the preceding examples, additionally or optionally, in the left-aligned bridge plate assembly the guide tube is shifted to left relative to the central axis of the support bracket, and in the right-aligned bridge plate assembly the guide tube is shifted to right relative to the central axis of the support bracket. In any or all of the preceding examples, additionally or optionally, a first guide tube of the left-aligned bridge plate assembly is a mirror image of a second guide tube of the right-aligned bridge plate assembly, and wherein, for each locking assembly of the left-aligned bridge plate assembly and of the right-aligned bridge plate assembly, the locking pin is spring-loaded and is slidable along a length of the hollow tube via a handle protruding out of an opening on the guide tube, at least a portion of the handle being perpendicular to the locking pin, and wherein the pivot pin is stationary. In any or all of the preceding examples, additionally or optionally, in the left-aligned bridge plate assembly, the first pivot pin is protruding outside a left edge of the support bracket and the first locking pin is positioned between the left edge and a right edge of the support bracket, and wherein in the right-aligned bridge plate assembly, the second pivot pin is protruding outside the right edge of the support bracket and the second locking pin is positioned between the left edge and the right edge of the support bracket. In any or all of the preceding examples, additionally or optionally, the locking assembly further comprises a support bracket coupled to the guide tube, and wherein the support bracket is in face sharing contact with the bridge plate, a surface of the support bracket curved to align with a curvature of the bridge plate.

Another example system (e.g., product line) of bridge plates, comprises: bridge plate system, comprising: a first bridge plate assembly comprising a first bridge plate and a center-aligned locking assembly attached to the first bridge plate, the center-aligned locking assembly having a first pivot pin coupled to a first guide tube, the first pivot pin confined within a left edge and a right edge of the first bridge plate, a second bridge plate assembly comprising a second bridge plate and a left-aligned locking assembly attached to the second bridge plate, the left-aligned locking assembly having a second pivot pin coupled to a second guide tube, the second pivot pin protruding out of the left edge of the second bridge plate, and a third bridge plate assembly comprising a third bridge plate and a right-aligned locking assembly attached to the third bridge plate, the right-aligned locking assembly having a third pivot pin coupled to a third guide tube, the third pivot pin protruding out of the right edge of the third bridge plate. In the preceding example, additionally or optionally, the first guide tube is a center-aligned guide tube mounted on a first support bracket center aligned with the first bridge plate, wherein the second guide tube is a left-aligned guide tube mounted on a second support bracket center aligned with the second bridge plate, and wherein the third guide tube is a right-aligned guide tube mounted on a third support bracket center aligned with the third bridge plate. In any or all of the preceding examples, additionally or optionally, the second bridge plate assembly is configured to be coupled to a right edge of a gap between two railcars with the second pivot pin engaged to a first receiving port on a first railcar deck, and wherein the third bridge plate assembly is configured to be coupled to a left edge of the gap with the third pivot pin engaged to a second receiving port on the first railcar deck, the second pivot pin facing the third pivot pin.

Another example method for a set of bridge plates, comprises: attaching a first, left-aligned bridge plate to a right side of a gap between a first railcar and a second railcar by engaging a left-aligned pivot pin protruding from a left edge of the first bridge plate with a second receiving port of the first railcar and engaging a left-aligned locking pin with a first receiving port of the first railcar, the left-aligned pivot pin coupled within a left-aligned hollow guide tube mounted on a first support bracket, and attaching a second, right-aligned bridge plate to a left side of the gap by engaging a right-aligned pivot pin protruding from a right edge of the second bridge plate with a third receiving port of the first railcar and engaging a right-aligned locking pin with a fourth receiving port of the first railcar, the right-aligned pivot pin coupled within a right-aligned hollow guide tube mounted on a second support bracket. In any preceding example, additionally or optionally, the first support bracket is centered relative to a central axis of the first bridge plate and the left-aligned guide tube is off-set to a left of the central axis of the first bridge plate, and wherein the second support bracket is centered relative to a central axis of the second bridge plate and the right-aligned guide tube is off-set to a right of the central axis of the second bridge plate. In any or all of the preceding examples, additionally or optionally, the first bridge plate is attached by sliding the left-aligned locking pin along the hollow left-aligned guide tube into a cavity of the first receiving port via a first handle coupled to the left-aligned locking pin within the left-aligned guide tube. In any or all of the preceding examples, additionally or optionally, the second bridge plate is attached by sliding the right-aligned locking pin along the hollow right-aligned guide tube into another cavity of the third receiving port via a second handle coupled to the right-aligned locking pin within the right-aligned guide tube.

In another embodiment, a bridge plate system includes a first bridge plate assembly and a second bridge plate assembly. The first bridge plate assembly includes a first bridge plate and a left-aligned locking assembly attached to the first bridge plate. The left-aligned locking assembly includes a hollow first guide tube having a side opening, a first pivot pin coupled to a first end of the first guide tube, and a spring-loaded first locking pin extending out of a second end of the first guide tube and being slidably retractable at least partly into the first guide tube via a first handle attached to the first locking pin and protruding out of the side opening of the first guide tube. One of the first pivot pin or the first locking pin protrudes out past the left edge of the first bridge plate. The second bridge plate assembly includes a second bridge plate and a right-aligned locking assembly attached to the second bridge plate. The right-aligned locking assembly includes a hollow second guide tube having a side opening, a second pivot pin coupled to a first end of the second guide tube, and a spring-loaded second locking pin extending out of a second end of the second guide tube and being slidably retractable at least partly into the second guide tube via a second handle attached to the second locking pin and protruding out of the side opening of the second guide tube. One of the second pivot pin or the second locking pin protrudes out past the right edge of the second bridge plate.

FIGS. 5A-D show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The following claims particularly point out certain combinations and sub-combinations regarded as novel and nonobvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for a bridge plate assembly, comprising:

a first bridge plate;

a second bridge plate;

a first locking assembly comprising a first guide tube holding a first pivot pin, and a first support bracket coupled to the first guide tube, wherein the first locking assembly has a center shifted to a side from a center of the first bridge plate, and wherein the first guide tube is shifted to left relative to a central axis of the first support bracket; and a second locking assembly comprising a second guide tube holding a second pivot pin, and a second support bracket coupled to the second guide tube, wherein the second locking assembly has a center shifted to a side from a center of the second bridge plate, and wherein the second guide tube is shifted to right relative to a central axis of the second support bracket.

2. The system of claim 1, wherein the central axis of the first support bracket aligned with the center of the first bridge plate, and wherein the first guide tube comprises an elongated hollow tube with the first pivot pin protruding out of one end of the first guide tube and a first locking pin protruding out of another, opposite end of the first guide tube, and wherein the central axis of the second support bracket aligned with the center of the second bridge plate, and wherein the second guide tube comprises an elongated hollow tube with the second pivot pin protruding out of one end of the second guide tube and a second locking pin protruding out of another, opposite end of the second guide tube.

3. The system of claim 1, wherein the first bridge plate is configured to be coupled at least at one end to a first receiving port of a dock of a railcar to span a gap between the railcar and an adjacent railcar.

4. The system of claim 3, wherein the second bridge plate is configured to be coupled at least at the one end to a second receiving port of the dock of the railcar.

5. The system of claim 4, wherein the first receiving port is one of a first, left receiving port coupled to a left side of the dock proximal to the first bridge plate assembly, and wherein the second receiving port is one of a second, right receiving port coupled to the right side of the dock proximal to the second bridge plate assembly.

6. The system of claim 5, wherein the first pivot pin has a center shifted to a left side from the center of the first bridge plate and the first bridge plate assembly with the first pivot pin shifted to the left side is a left-aligned bridge plate assembly.

7. The system of claim 6, wherein the second pivot pin has a center shifted to a right side from the center of the second bridge plate and the second bridge plate assembly with the second pivot pin shifted to the right side is a right-aligned bridge plate assembly.

8. The system of claim 7, wherein the left-aligned bridge plate assembly is placed along a right edge of the gap between two adjacent railcars and wherein the right-aligned bridge plate assembly is placed along a left edge of the gap between two adjacent railcars, a left-aligned bridge plate parallel to a right-aligned bridge plate.

9. The system of claim 7, wherein a distance between outer edges of the left-aligned bridge plate parallel and the right-aligned bridge plate is in a range of 86-92 inches, and wherein a distance between inner edges of the left-aligned bridge plate parallel and the right-aligned bridge plate is in a range of 41-47 inches.

10. The system of claim 7, wherein the first guide tube is a mirror image of a second guide tube, and wherein the left-aligned bridge plate assembly comprises a first locking pin, the right-aligned bridge plate assembly comprises a second locking pin, and each of the first and second locking pins is spring-loaded and is slidable along a length of the hollow tube via a handle protruding out of an opening on the first and second guide tubes, at least a portion of the handle being perpendicular to the first and second locking pins, and wherein each of the first and second pivot pins is stationary.

11. The system of claim 7, wherein in the left-aligned bridge plate assembly, the first pivot pin is protruding outside a left edge of the first support bracket and the first locking pin is positioned between the left edge and a right edge of the first support bracket, and wherein in the right-aligned bridge plate assembly, the second pivot pin is protruding outside the right edge of the second support bracket and the second locking pin is positioned between the left edge and the right edge of the second support bracket.

12. The system of claim 1, wherein each of the first and second support brackets is in face sharing contact with the first or second bridge plate, a surface of each of the first and second support brackets curved to align with a curvature of the first or second bridge plate.

13. A bridge plate system, comprising:

a first bridge plate assembly comprising a first bridge plate and a center-aligned locking assembly attached to the first bridge plate, the center-aligned locking assembly having a first pivot pin coupled to a first guide tube, the first pivot pin confined within a left edge and a right edge of the first bridge plate;

a second bridge plate assembly comprising a second bridge plate and a left-aligned locking assembly attached to the second bridge plate, the left-aligned locking assembly having a second pivot pin coupled to a second guide tube, the second pivot pin protruding out of the left edge of the second bridge plate; and a third bridge plate assembly comprising a third bridge plate and a right-aligned locking assembly attached to the third bridge plate, the right-aligned locking assembly having a third pivot pin coupled to a third guide tube, the third pivot pin protruding out of the right edge of the third bridge plate.

14. The system of claim 13, wherein the first guide tube is a center-aligned guide tube mounted on a first support bracket center aligned with the first bridge plate, wherein the second guide tube is a left-aligned guide tube mounted on a second support bracket center aligned with the second bridge plate, and wherein the third guide tube is a right-aligned guide tube mounted on a third support bracket center aligned with the third bridge plate.

15. The system of claim 13, wherein the second bridge plate assembly is configured to be coupled to a right edge of a gap between two railcars with the second pivot pin engaged to a first receiving port on a first railcar deck, and wherein the third bridge plate assembly is configured to be coupled to a left edge of the gap with the third pivot pin engaged to a second receiving port on the first railcar deck, the second pivot pin facing the third pivot pin.

* * * * *